US011319952B2

(12) United States Patent
Crosby et al.

(10) Patent No.: US 11,319,952 B2
(45) Date of Patent: May 3, 2022

(54) HYDRAULIC MOTOR SUBASSEMBLY KIT WITH CARRIER

(71) Applicant: Parker-Hannifin Corporation, Cleveland, OH (US)

(72) Inventors: Michael T. Crosby, Jonesborough, TN (US); Brian T. Painter, Chuckey, TN (US); Kenneth T. Cornett, Jonesborough, TN (US); Timothy E. King, Afton, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 17/040,764

(22) PCT Filed: May 22, 2019

(86) PCT No.: PCT/US2019/033515
§ 371 (c)(1),
(2) Date: Sep. 23, 2020

(87) PCT Pub. No.: WO2019/236295
PCT Pub. Date: Dec. 12, 2019

(65) Prior Publication Data

US 2021/0003128 A1 Jan. 7, 2021

Related U.S. Application Data

(60) Provisional application No. 62/681,899, filed on Jun. 7, 2018.

(51) Int. Cl.

| | |
|---|---|
| ***F04B 53/22*** | (2006.01) |
| ***F04C 2/08*** | (2006.01) |
| ***F04C 2/10*** | (2006.01) |

(52) U.S. Cl.
CPC ..... *F04B 53/22* (2013.01); *F04C 2/084* (2013.01); *F04C 2/102* (2013.01);
(Continued)

(58) Field of Classification Search
CPC ..... F04C 2230/60; F04C 2230/603; F04C 2230/604; F04C 2230/80–85; F04C 2240/30; F04B 39/14; F04B 53/22
See application file for complete search history.

(56) References Cited

U.S. PATENT DOCUMENTS

| | | | |
|---|---|---|---|
| 3,927,763 A | 12/1975 | Strub et al. | |
| 4,098,558 A | 7/1978 | Bush et al. | |

(Continued)

FOREIGN PATENT DOCUMENTS

| | | | |
|---|---|---|---|
| DE | 202009001316 U1 * | 4/2009 | ..... F04C 2/16 |
| DE | 102016013036 | 5/2018 | |

OTHER PUBLICATIONS

International Search Report and Written Opinion for corresponding international patent application No. PCT/US2019/033515 dated Sep. 12, 2019.

*Primary Examiner* — Laert Dounis
(74) *Attorney, Agent, or Firm* — Renner, Otto, Boisselle & Sklar, LLP

(57) ABSTRACT

A carrier for a motor subassembly of a hydraulic motor is provided that enables multiple components of the motor subassembly to be temporarily bundled into a compact and easy-to-transport motor subassembly kit. The carrier is a non-hydraulically-functioning member that is configured to have one or more features that mimic a corresponding one or more features of a hydraulically-functioning motor housing to which motor subassembly is intended to be coupled for forming the hydraulic motor. The carrier may have a body with a recessed portion that is configured to receive and/or enclose one or more components of the motor sub- (Continued)

assembly, and which may cooperate with the one or more motor subassembly components to temporarily secure and bundle the motor subassembly as a compact kit, thereby facilitating transportation and handling of the subassembly components.

20 Claims, 13 Drawing Sheets

(52) U.S. Cl.
CPC .. *B65D 2585/6877* (2013.01); *F04C 2230/85* (2013.01); *F04C 2240/20* (2013.01); *F04C 2240/30* (2013.01); *F04C 2240/40* (2013.01); *F04C 2240/60* (2013.01)

(56) References Cited

U.S. PATENT DOCUMENTS

| | | | | |
|---|---|---|---|---|
| 4,389,166 | A * | 6/1983 | Harvey | F04B 35/04 417/234 |
| 7,185,579 | B2 | 3/2007 | Allart et al. | |
| 7,695,258 | B2 | 4/2010 | White, Jr. | |
| 9,121,395 | B2 | 9/2015 | Gray, Jr. | |
| 9,284,942 | B2 | 3/2016 | Allart et al. | |
| 9,657,729 | B2 | 5/2017 | Rasch | |
| 2014/0023543 | A1 | 1/2014 | Attarde et al. | |

* cited by examiner

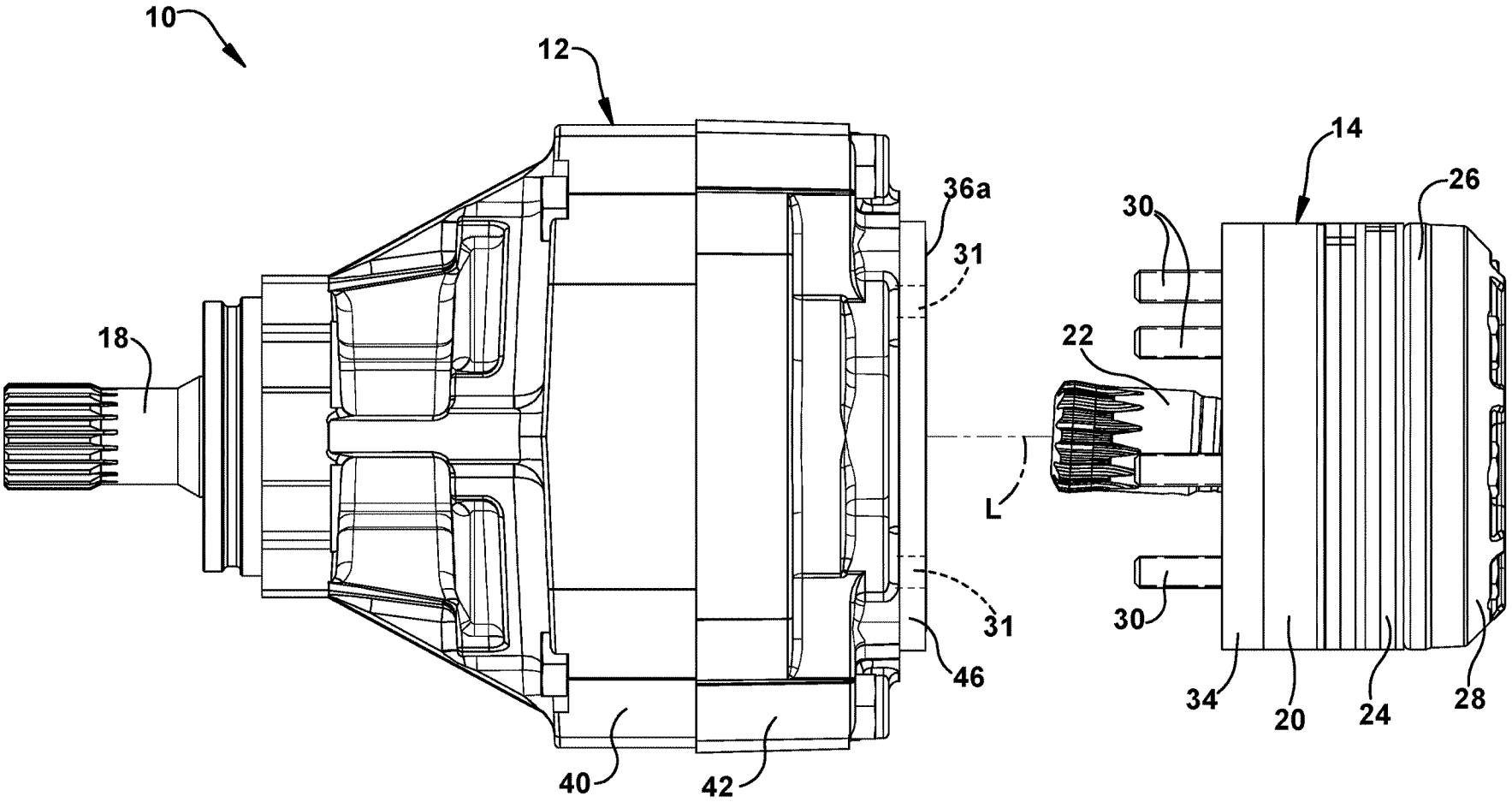
Fig. 1
(Conventional)

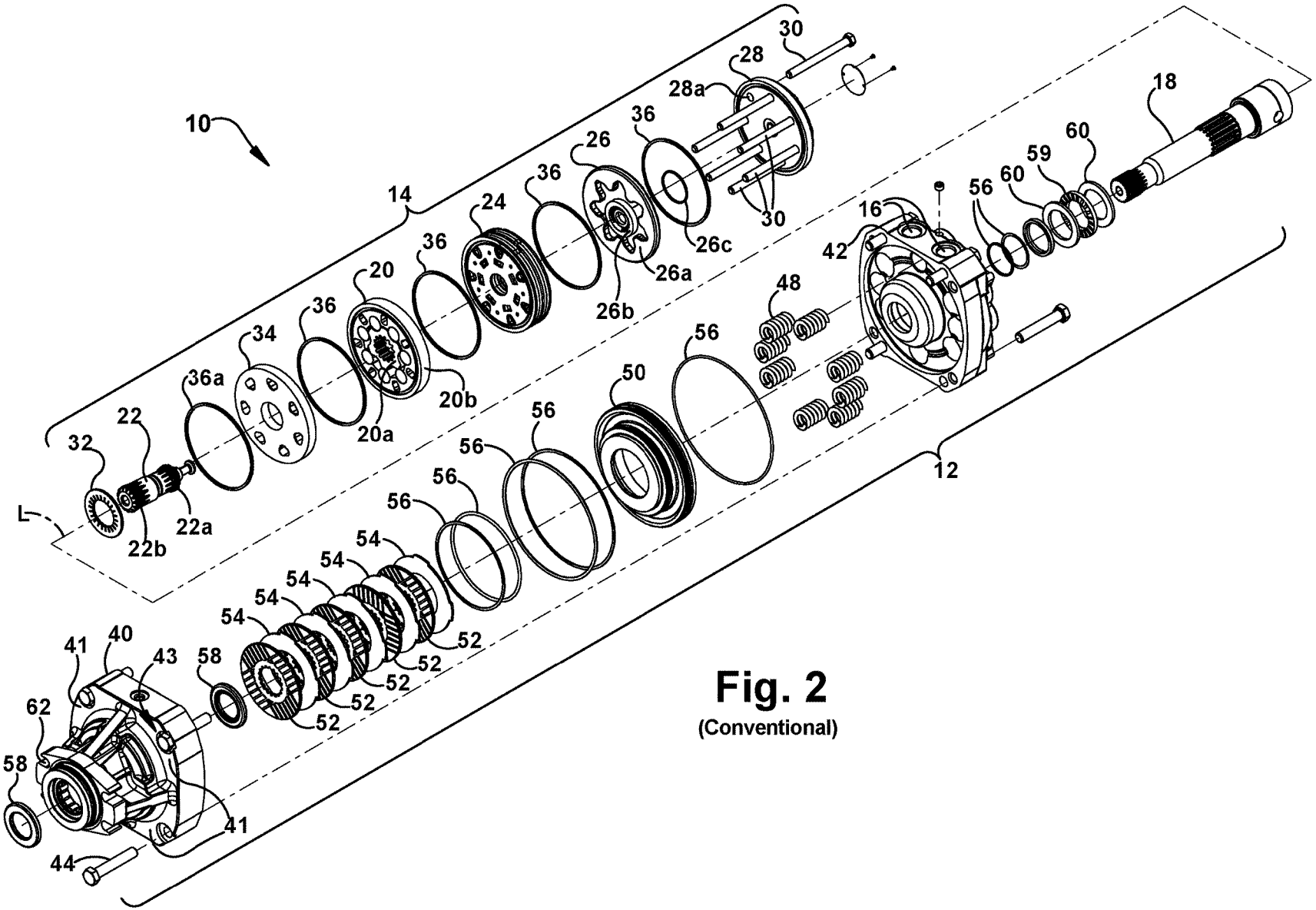
Fig. 2
(Conventional)

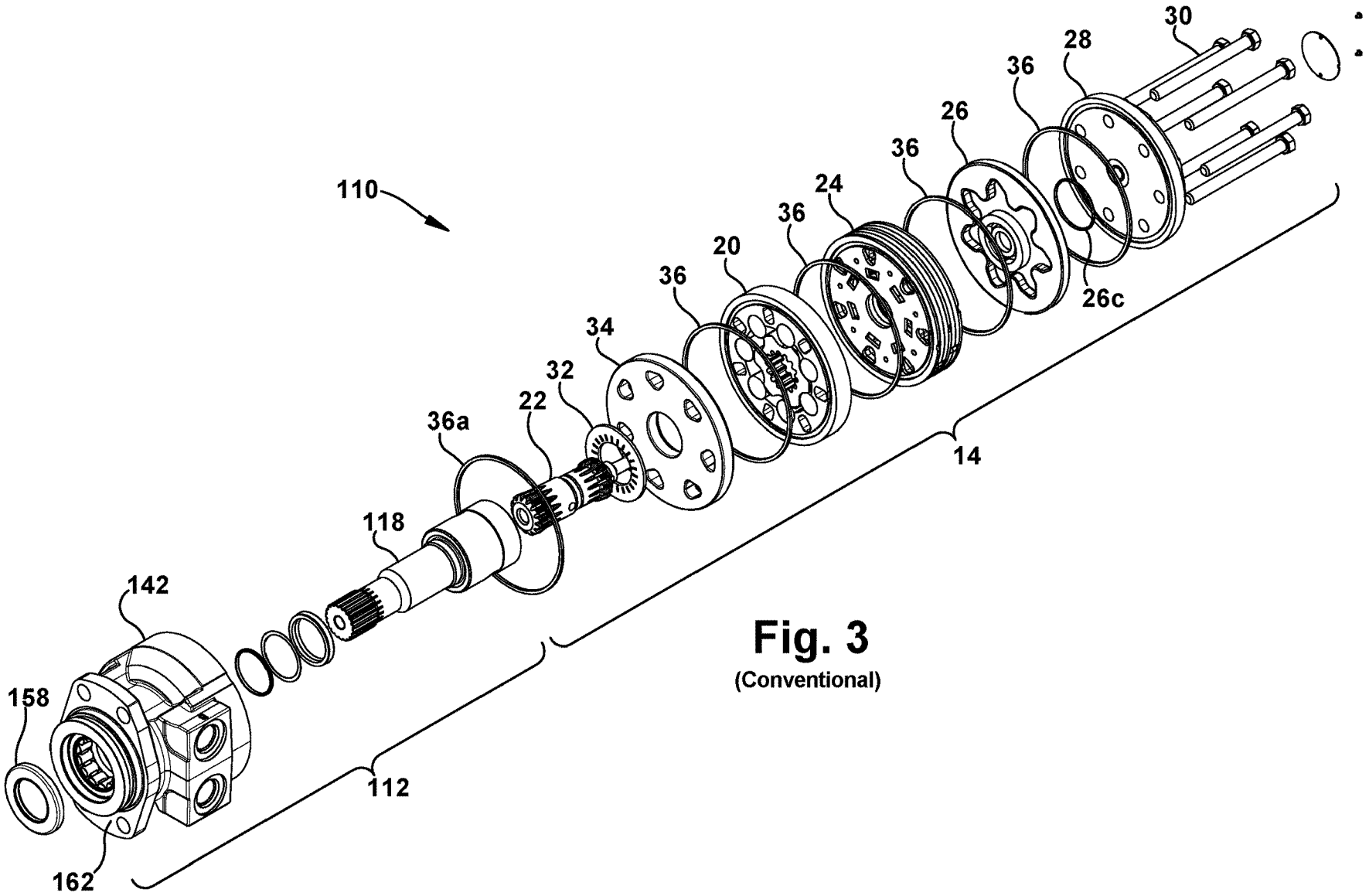
Fig. 3
(Conventional)

HYDRAULIC MOTOR SUBASSEMBLY KIT WITH CARRIER

RELATED APPLICATIONS

This application is a national phase of International Application No. PCT/US2019/33515 May 22,2019 and published in the English language, which claims the benefit of U.S. Provisional Application No. 62/681,899 filed on Jun. 7, 2018, all of which are hereby incorporated herein by reference in their entireties.

FIELD OF INVENTION

The present invention relates generally to hydraulic motors, and more particularly to motor subassemblies for hydraulic motors that are included in a kit having a carrier for securing the motor subassembly.

BACKGROUND

Hydraulic fluid systems are utilized to generate power in a variety of industries. Mining and drilling equipment, construction equipment, motor vehicle transmission systems, and various other industrial applications employ such hydraulic systems. In hydraulic driving or control, a hydraulic pump transfers pressurized hydraulic fluid to a hydraulic motor with an output shaft that drives rotation of an end use element (e.g., wheel axle, gear box, rotating fan, or other suitable usage). The motor output that drives the output shaft is regulated by suitable hydraulic valves that control hydraulic fluid flow through the system.

There are numerous types of hydraulic motors utilized in these various industries, including gear motors, hydraulic brake motors, gerotor motors, hydraulic radial piston motors, hydrostatic transmission motors, hydraulic vane motors, bent axis motors, and the like, all of which are well-known in the art. Typically these hydraulic motors will have a motor housing with external fluid ports that fluidly connect with the pump to enable operation of the motor. A motor subassembly is often coupled to the motor housing to complete the hydraulic motor. The motor subassembly usually includes many of the moving components of the motor through which torque is generated and transferred to the output shaft.

SUMMARY OF INVENTION

Because the motor subassembly includes many of the moving components that generate and transfer the torque provided by the motor, these components of the motor subassembly can wear out and may need to be replaced over time without complete motor replacement. In addition, many authorized build centers or remote assembly locations may have difficulty procuring all of the components of the motor subassembly individually, compared to the relative ease of procuring a displacement specific motor subassembly. As such, these assemblers typically will order each individual component of the motor subassembly from the manufacturer, which are then shipped in individual packages to the assembler, where each individual component is then assembled to the motor housing to refurbish the hydraulic motor. This can include up to twelve or more such individual components of the motor subassembly being packaged, transported, tracked, and stored, which results in wasted time and expense for both the manufacturer and assembler.

The present invention provides a motor subassembly kit for a hydraulic motor, with a carrier that enables the multiple components of the motor subassembly to be temporarily bundled into one compact, easy-to-order, easy-to-assemble, easy-to-transport, and/or easy-to-store kit.

More particularly, the carrier is a temporary, non-hydraulically-functioning member that may be configured to have one or more features that mimic a corresponding one or more features of a hydraulically-functioning motor housing to which motor subassembly is intended to be coupled for forming the hydraulic motor.

For example, the carrier may have a flange with support regions that mimic the preexisting support regions on the hydraulically-functioning motor housing. Such a configuration may enable the motor subassembly kit with carrier to be easily packaged into existing dunnage for facilitating transportation, and/or may enable the kit to be easily placed in existing assembly workstations for facilitating assembly of the motor subassembly components.

Alternatively or additionally, the carrier may include receivers for receiving fasteners of the motor subassembly, in which the locations of these carrier receivers may mimic the preexisting locations of corresponding receivers on the motor housing that receive the same fasteners. Such a configuration of the carrier may enable the motor subassembly kit to be easily secured into a single transportable bundle by using the existing motor subassembly fasteners. Other such mimicry of the motor housing by the carrier may be provided.

According to one aspect of the invention, a non-hydraulically-operable carrier for temporarily carrying a motor subassembly configured to be coupled to a hydraulically-operable motor housing for forming a hydraulic motor includes: a body having a first end portion, a second end portion, and an intermediate portion between the first end portion and the second end portion; and a recessed portion within the body, the recessed portion having an opening for receiving a portion of the motor subassembly, the recessed portion forming an enclosure that is configured to contain the portion of the motor subassembly; wherein the carrier is configured to cooperate with the motor subassembly to temporarily secure the motor subassembly as a transportable bundle, and wherein the carrier has one or more portions that mimic a corresponding one or more portions of the hydraulically-operable motor housing, thereby facilitating transportation of the motor subassembly.

According to another aspect of the invention, a motor subassembly kit for a hydraulic motor includes: a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly; wherein the carrier cooperates with the motor subassembly to temporarily secure the plurality of motor components of the motor subassembly as a transportable bundle, and wherein the carrier has one or more portions that mimic a corresponding one or more portions of the hydraulically-operable motor housing, thereby facilitating transportation of the plurality of motor components in the transportable bundle.

According to another aspect of the invention, a method of transporting a motor subassembly for a hydraulic motor includes: (i) providing a non-hydraulically-operable carrier; (ii) providing a motor subassembly having one or more of the following motor components: a torque transferor, a torque generator, a fluid manifold, a fluid timer, an end cover, and fasteners; (iii) securing the carrier to the motor subassembly to form a motor subassembly kit as a transportable bundle; and (iv) transporting the motor subassembly kit.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

FIG. 1 is a side plan view of a conventional motor housing and a conventional motor subassembly that together form a prior art hydraulic motor.

FIG. 2 is an exploded perspective view of the conventional motor housing and the conventional motor subassembly in FIG. 1.

FIG. 3 is perspective view of another conventional motor housing with an exploded perspective view of the conventional motor subassembly in FIG. 2 to form another conventional hydraulic motor.

DETAILED DESCRIPTION

Figure 4:
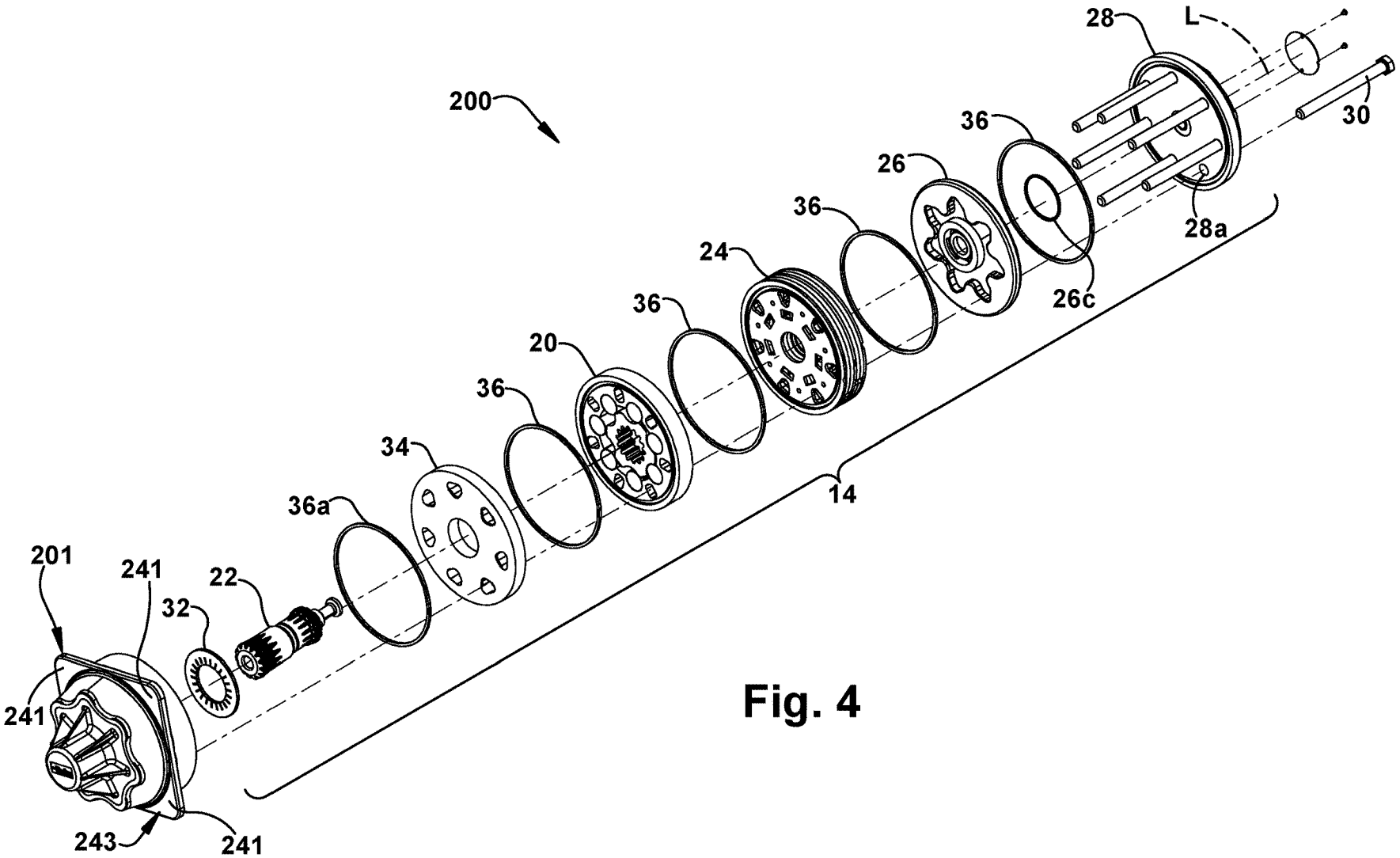
FIG. 4 is an exploded perspective view of an exemplary motor subassembly kit with an exemplary carrier and the motor subassembly in FIGS. 2 and 3.
Figure 5:
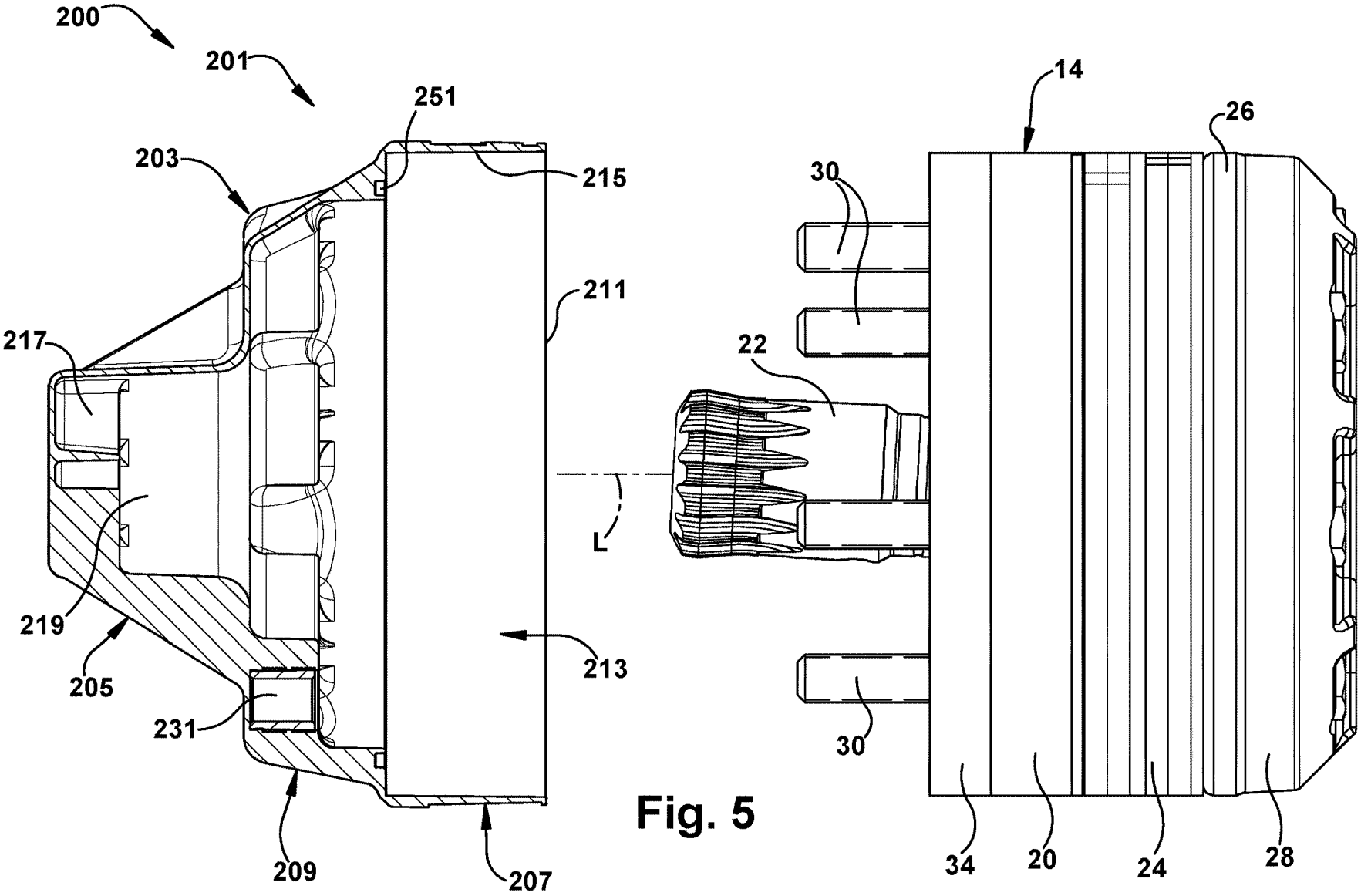
FIG. 5 is a partially exploded side view of the motor subassembly kit in FIG. 4, with the carrier shown in cross-section along the line A-A in FIG. 6, and the motor subassembly shown in plan view.
Figure 7:
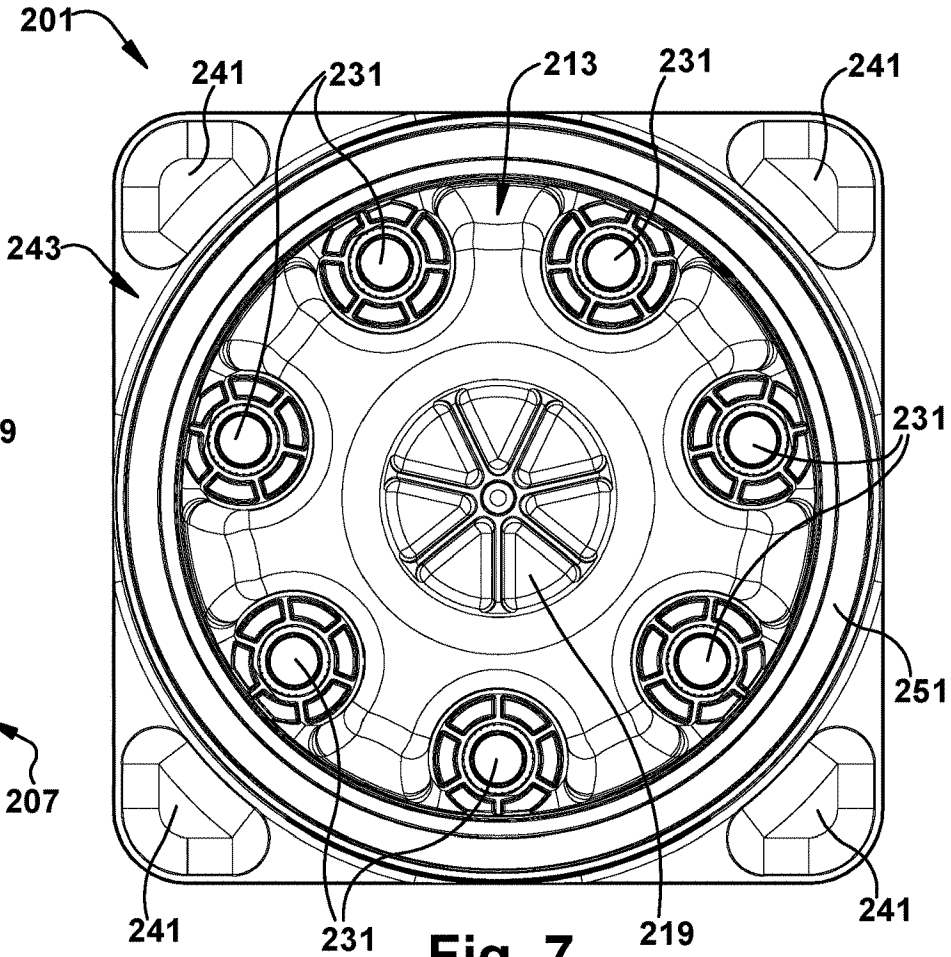
FIG. 7 is a bottom view of the carrier.
Figure 6:
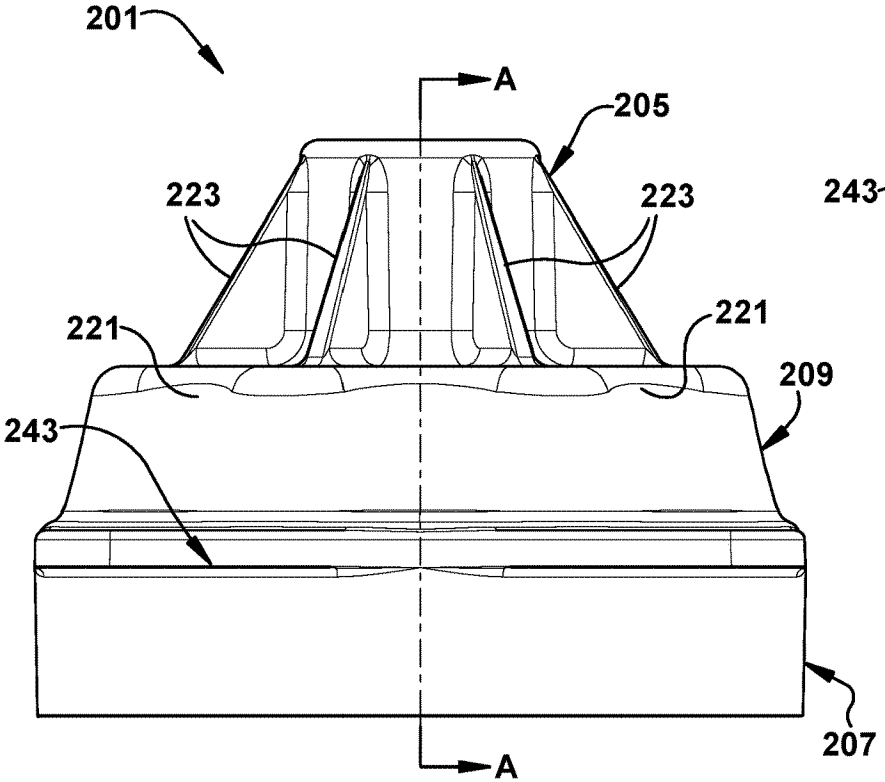
FIG. 6 is a side plan view of the carrier.
Figure 8:
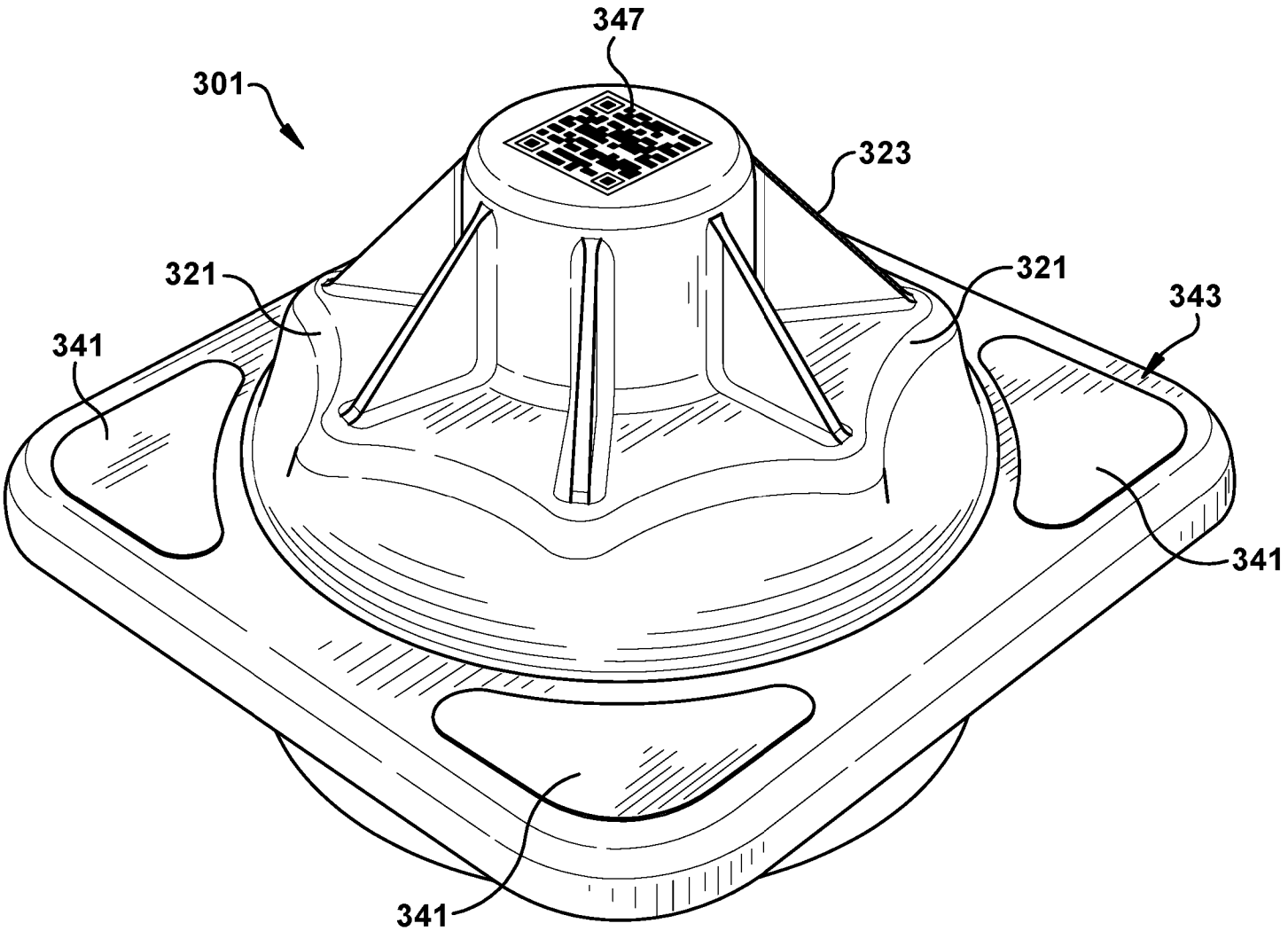
FIG. 8 is a perspective view of another exemplary carrier.
Figure 10:
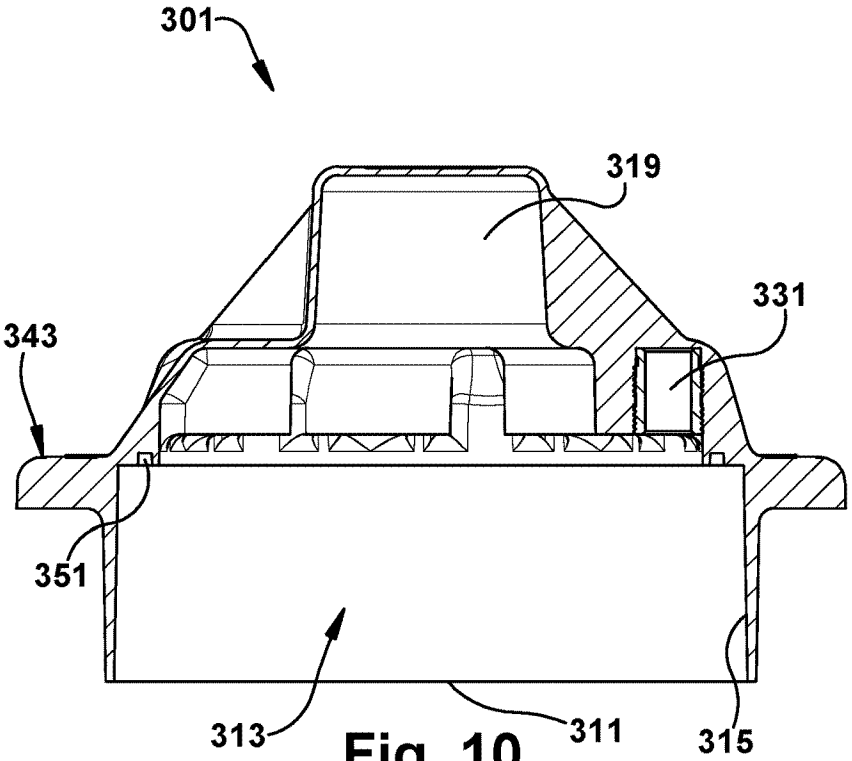
FIG. 10 is a cross-sectional view taken along the B-B in FIG. 9.
Figure 9:
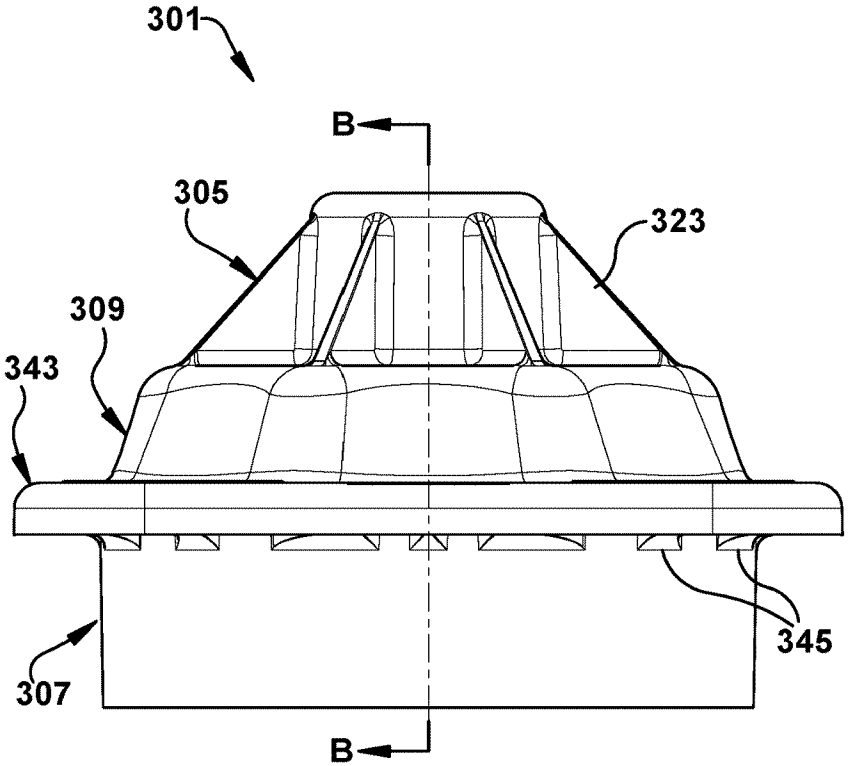
FIG. 9 is a side plan view of the carrier in FIG. 8.
Figure 12:
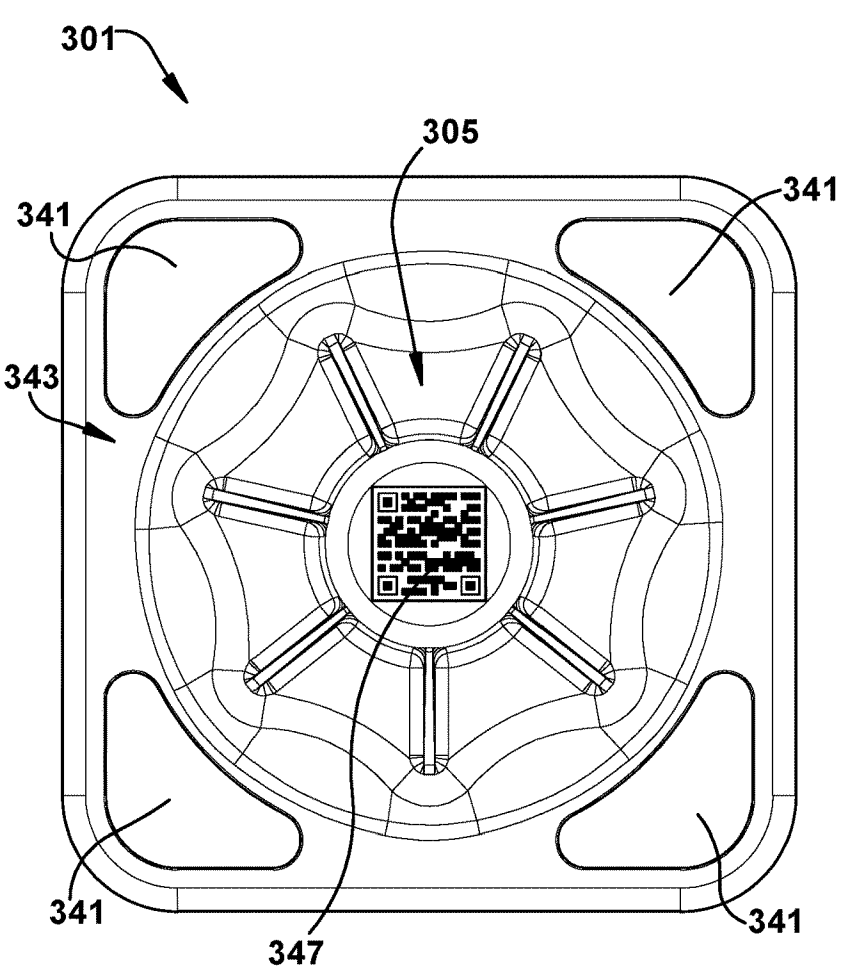
FIG. 12 is a top view of the carrier in FIG. 9.
Figure 11:
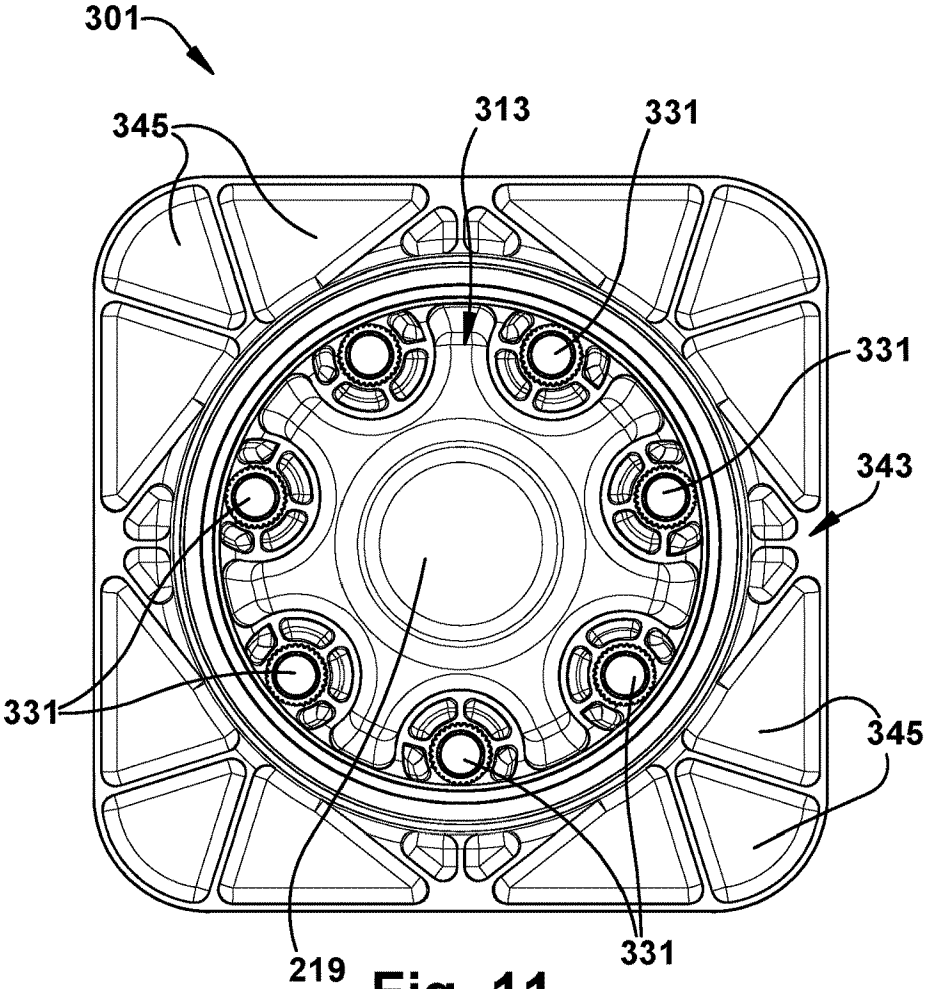
FIG. 11 is a bottom view of the carrier in FIG. 9.
Figure 13:
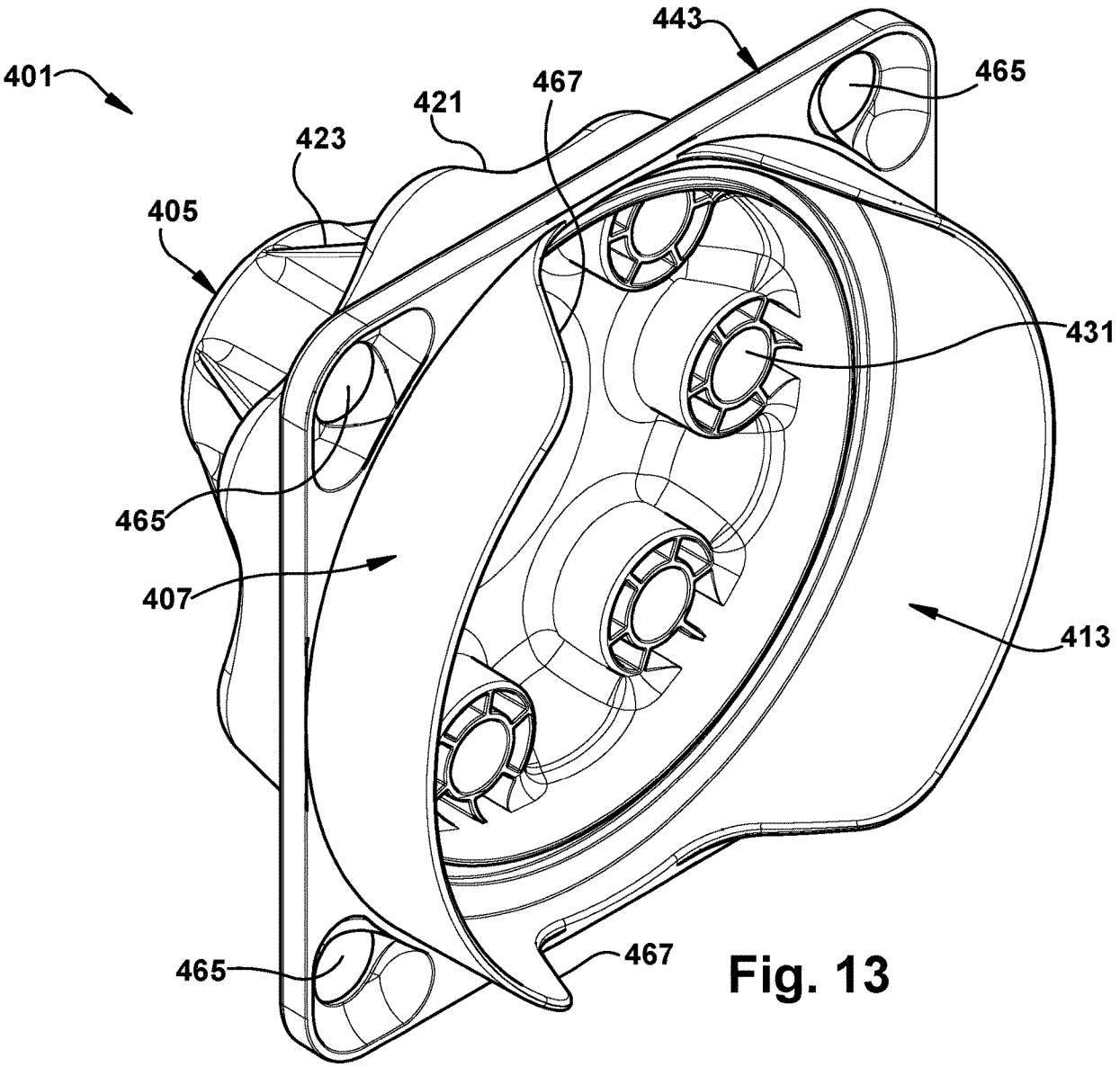
FIG. 13 is a bottom perspective view of another exemplary carrier.
Figure 15:
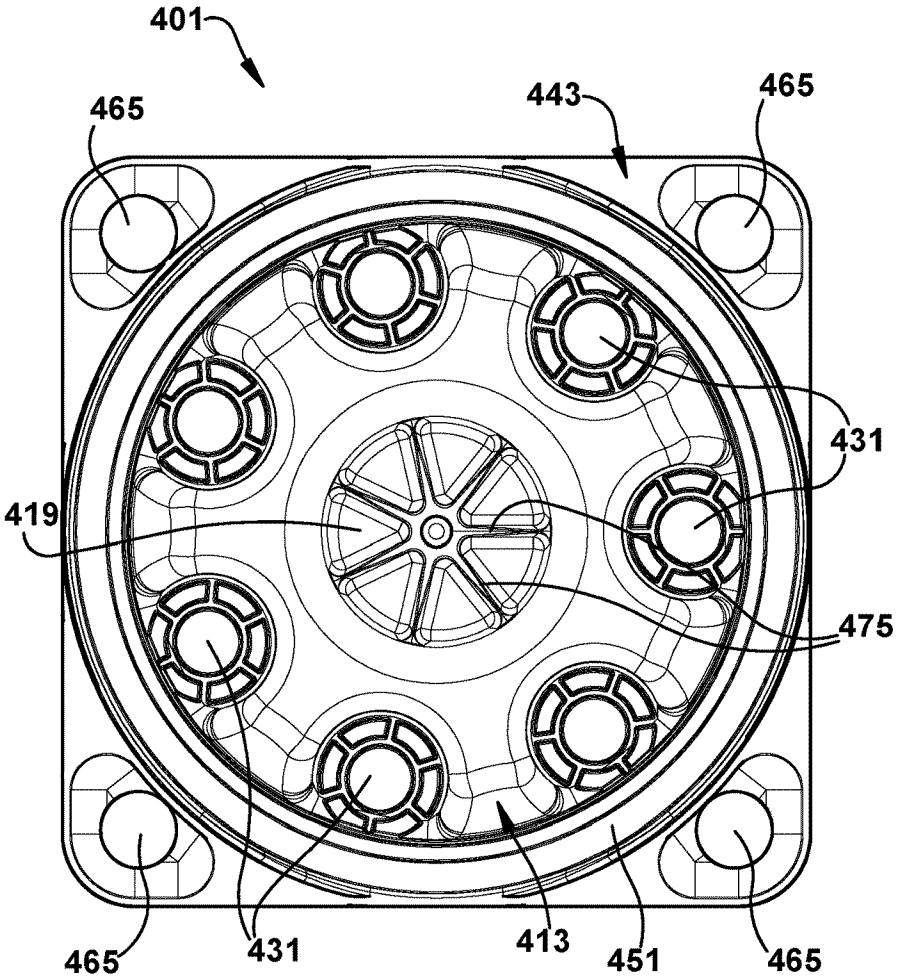
FIG. 15 is a bottom plan view of the carrier in FIG. 13.
Figure 14:
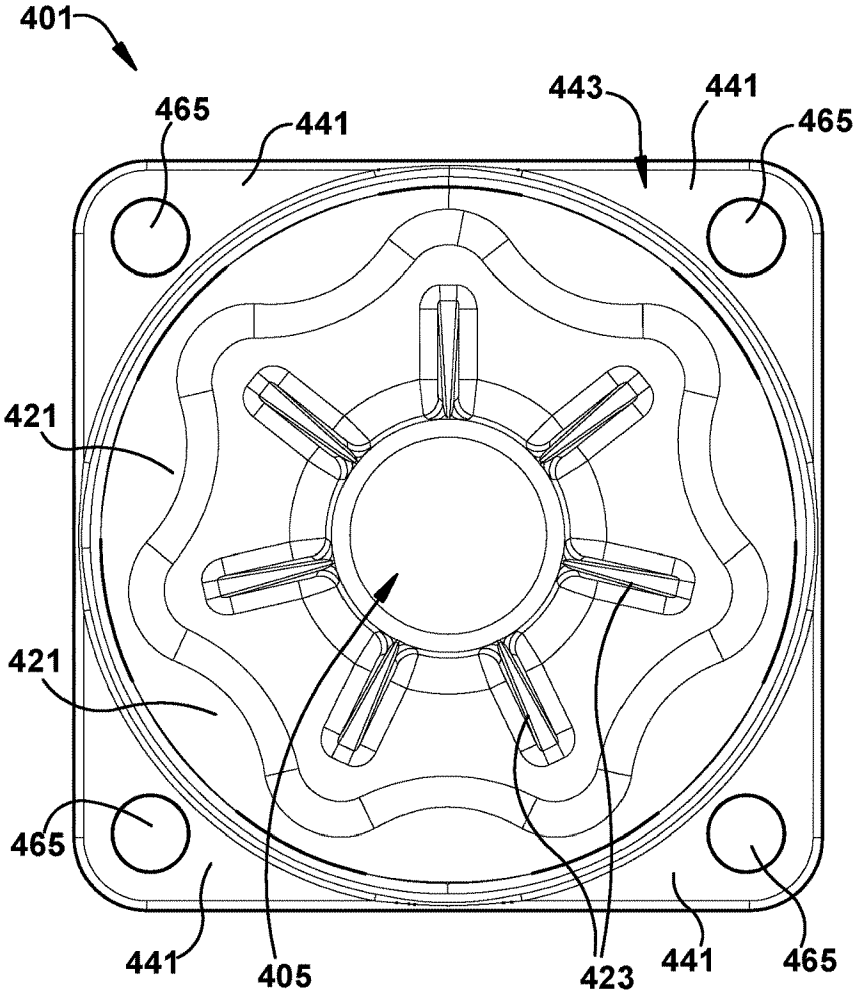
FIG. 14 is a top plan view of the carrier in FIG. 13.
Figure 17:
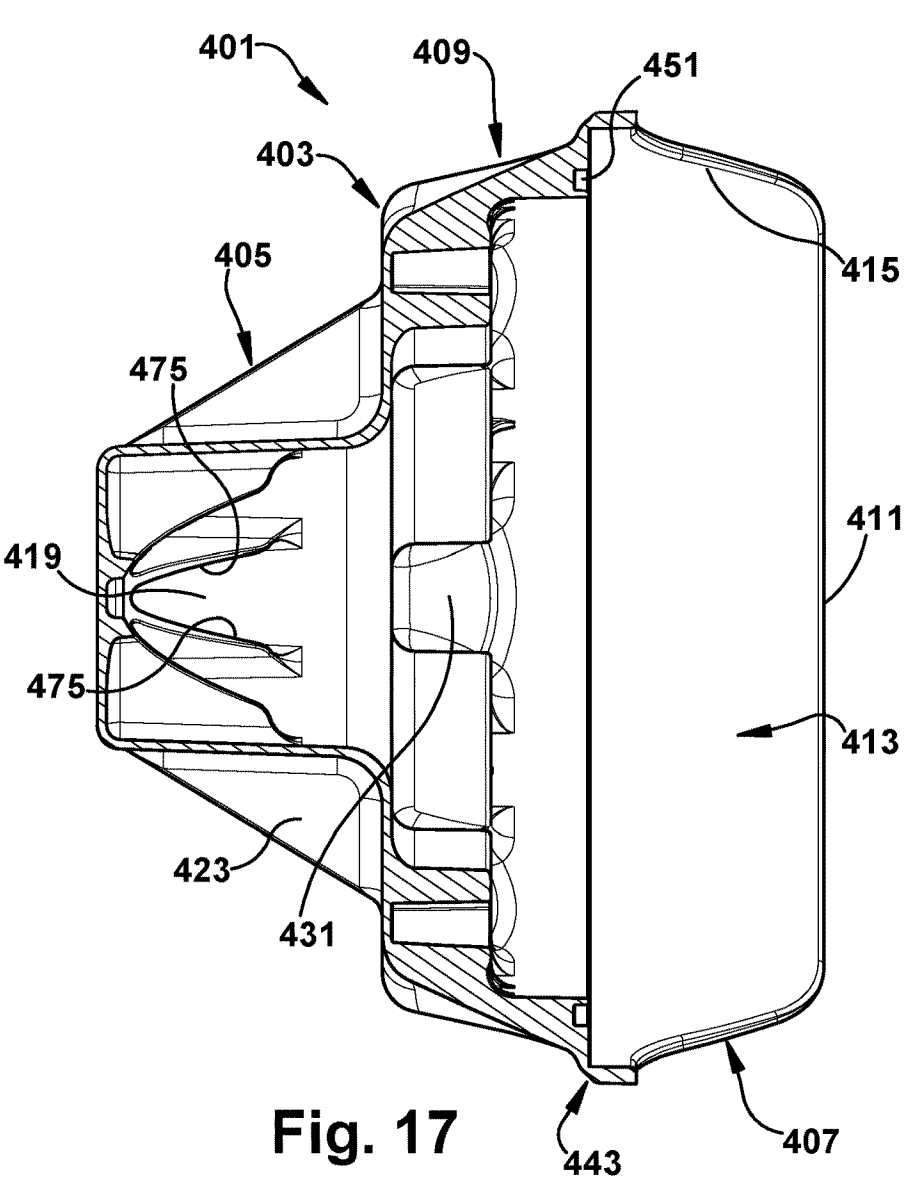
FIG. 17 is a cross-sectional side view taken along the C-C in FIG. 16.
Figure 16:
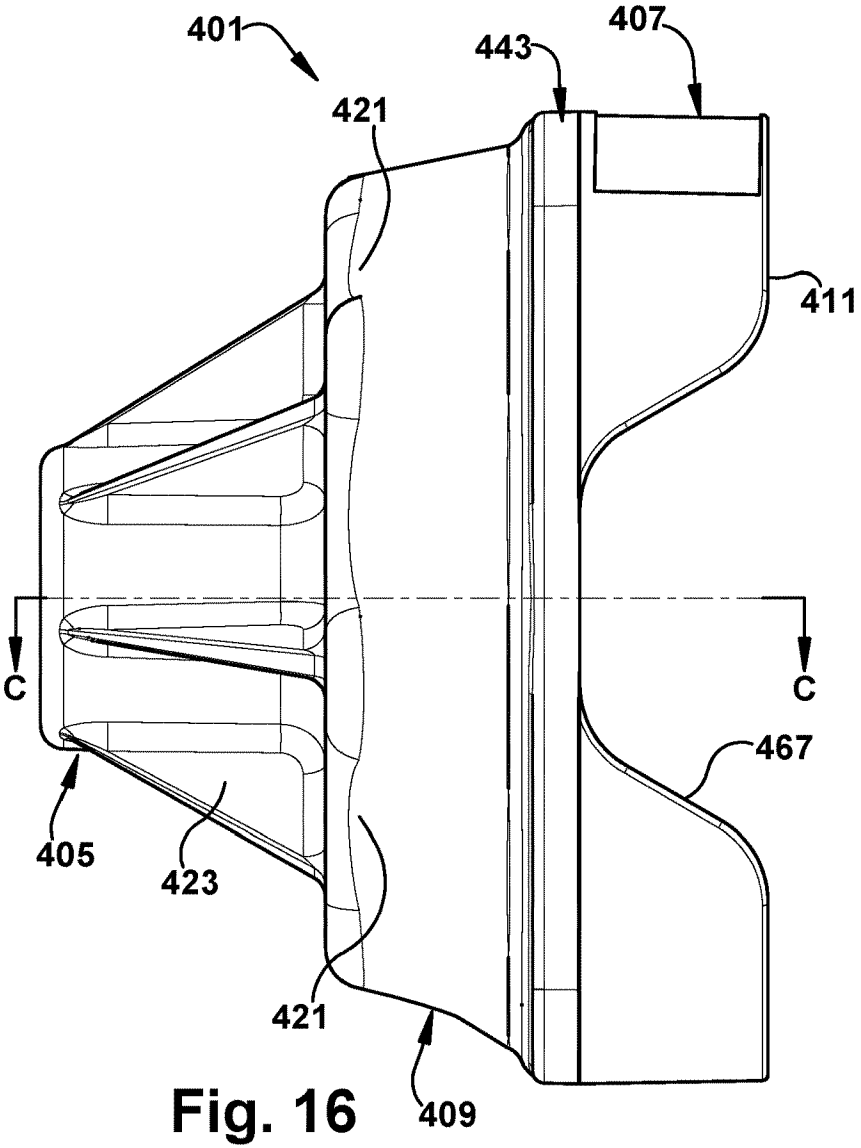
FIG. 16 is a side plan view of the carrier in FIG. 13.

According to an aspect of the present disclosure, a carrier for a motor subassembly of a hydraulic motor is provided that enables multiple components of the motor subassembly to be temporarily bundled into a compact and easy-to-transport motor subassembly kit. The carrier is a non-hydraulically-functioning member that is configured to have one or more features that mimic a corresponding one or more features of a hydraulically-functioning motor housing to which the motor subassembly is intended to be coupled for forming the hydraulic motor. The carrier may have a body with a recessed portion that is configured to receive and/or enclose one or more components of the motor subassembly, and which may cooperate with the one or more motor subassembly components to temporarily secure the motor subassembly as a compact kit, thereby facilitating transportation and handling of the subassembly components.

The principles of the present disclosure have particular application to hydraulic gerotor motors, and thus will be described below chiefly in this context. It is understood, however, that the principles and aspects according to the present disclosure may be applicable to other hydraulic motors for various applications, such as gear motors, hydraulic brake motors, hydraulic radial piston motors, hydrostatic transmission motors, hydraulic vane motors, bent axis motors, and the like, such as for use in mining and drilling equipment, construction equipment, motor vehicle transmission systems, and various other industrial applications that employ such hydraulic motors.

Referring to FIGS. 1 and 2, an example of a conventional hydraulic motor 10 is shown. Generally, the motor 10 includes a motor housing 12 and a motor subassembly 14 coupled to the motor housing 12. The motor housing 12 (also referred to as a housing assembly) may include a metal casting, and includes fluid ports 16 for transferring pressurized hydraulic fluid, such as from a pump, for enabling operation of the motor 10 in a well-known manner. The motor subassembly 14 includes a plurality of components, including moving components of the motor through which torque is generated and transferred to an output shaft 18, as discussed below. Generally, the output shaft 18 constitutes a part of the motor housing assembly 12, and is configured to extend from the motor housing 12 to drive rotation of an end use element (e.g., wheel axle, gear box, rotating fan, or other suitable usage). Such output of the hydraulic motor 10 that drives the output shaft 18 is regulated by controlling hydraulic fluid flow through the hydraulic motor.

To generate and transfer torque to the output shaft 18, the motor subassembly generally includes a suitable torque generator 20 and a torque transferor 22 that operate in a well-known manner. To control the flow of fluid through the hydraulic motor, the motor subassembly also generally includes a fluid manifold 24 and a suitable fluid timer 26. To secure the components together, the motor subassembly may include an end plate 28 and one or more fasteners 30. The motor subassembly also may include a suitable thrust loader 32, a wear member 34, and one or more seals 36, all of which function in a manner well known to those having ordinary skill in the art.

In the illustrated example, the hydraulic motor 10 is a gerotor motor configuration with an integrated hydraulic brake assembly. In this example, the motor subassembly 14 constitutes the gerotor portion of the motor 10 for generating and transferring torque. In the illustrated configuration, the torque generator 20 of the motor subassembly includes a rotor assembly, and the torque transferor 22 includes a longitudinally extending drive link configured to couple with the output shaft 18. The fluid timer 26 in the illustrated configuration includes a commutator, the thrust loader 32 includes a thrust bearing, and the wear member 34 includes a wear plate, the operation for all of which is described in further detail below. An example of the hydraulic motor 10 is a LSHT motor with an integrated spring applied hydraulic release brake assembly by Parker-Hannifin Corporation of Cleveland, Ohio having hydraulic motor part number BG014ZS060ABAL, with motor housing part number TG012026B1 and motor subassembly part number MSKBG0140S0ABAL.

In the illustrated example, the motor housing assembly 12 constitutes the hydraulic brake portion of the motor 10 with the output shaft 18 extending therefrom to drive rotation of an end use element (not shown). In the illustrated configuration, the housing assembly 12 includes a front housing segment 40 and a rear housing segment 42 that are coupled together with fasteners 44 to form an enclosure through which pressurized hydraulic fluid flows to enable operation of the motor 10. The housing 12 includes the hydraulic fluid ports 16 for transferring the pressurized hydraulic fluid from the fluid source, such as a pump, through the housing to a manifold 46 in the rear housing segment 42, and then through the manifold 46 to the motor subassembly 14 for generating torque to drive the output shaft 18. In the illustrated example, the motor housing assembly 12 includes a brake assembly, such as for use with a crane or winch having a suspended load. The brake assembly operates in a well-known manner, and includes springs 48, a brake motor piston 50, one or more rotating friction discs 52, and one or more stationary separator plates 54 that operate together to provide load-holding functionality. As shown, the motor housing 12 also includes one or more O-ring seals 56 and one or more dirt and water seals 58. A thrust bearing 59 and thrust washers 60 also may be provided.

The known hydraulic motor shown in FIGS. 1 and 2 operates in a manner well known to those having ordinary skill in the art, and thus will be described briefly. In the illustrated example, the hydraulic motor 10 includes the motor housing 12 that receives the output shaft 18. The output shaft 18 extends through the motor housing 12 for ultimately driving the end use element (not shown), either directly or through a gear reduction assembly as are known in the art. The torque generator 20 (e.g., rotor set) of the motor subassembly 14 is secured to the motor housing 12 via the wear member 34 (e.g., wear plate). The external fluid ports 16 of the motor housing 12 open outwardly for fluid connection to the fluid source, such as the pump, and enable transfer of the fluid through the rear manifold 46 of the motor housing to and from the motor subassembly 14 via the fluid manifold 24, which includes one or more internal fluid ports. The fluid manifold 24 is supported adjacent to the fluid timer 26 (e.g., commutator ring 26*a* that encloses the commutator 26*b* and sealed with a commutator seal 26*c*), and communicates the hydraulic fluid to the torque generator 20 (e.g., rotor set) via the fluid manifold 24.

In the illustrated example, the gerotor configuration of the torque generator 20 (e.g., rotor set) includes an inner rotor 20*a* that rotates within a stator 20*b* against and relative to a plurality of roller vanes. The inner rotor 20*a* rotates under the force of the hydraulic fluid flow through the motor from the fluid source. Spaces defined between the inner rotor 20*a* and stator 20*b* change volume as the inner rotor rotates within the stator relative to the roller vanes. This action permits the inflow and forces the outflow of the hydraulic fluid from the motor, which causes the inner rotor 20*a* to rotate. In the illustrated example, the motor subassembly components further include the torque transferor 22 (e.g., drive link) that is supported in position at least in part with the thrust loader 32 (e.g., thrust washer). In the illustrated example, the drive link includes first splines 22*a* that interface with splines of the inner rotor 20*a*, such that the rotation of the inner rotor drives the rotation of the drive link. The drive link further includes second splines 22*b* that interface with a cooperating spline of the output shaft 18. Through such interfacing linkages, the motor rotor drives the output shaft via the drive link.

In some examples, the motor subassembly may be configured as a modular unit that is adapted for use across multiple hydraulic motor designs having different motor housings. This allows a customer-specific motor housing with customized mounting flanges, fluid port locations, output shaft designs, and other features to utilize the same motor subassembly that is used for other customized motor housings.

For example, referring to FIG. 3, another example of a conventional hydraulic motor 110 is shown in which the same motor subassembly 14 is coupled to a different known motor housing 112 to form the known hydraulic motor 110. The motor housing 112 is substantially similar to the above-referenced motor housing 12, and consequently the same reference numerals but indexed by 100 are used to denote structures corresponding to similar structures in the motor housings 12, 112. As shown, the motor housing 112 has an output shaft 118 extending therefrom to drive rotation of an end use element (not shown) in a similar manner as described above. However, the motor housing 112 has a different outer housing configuration than the housing 12, such as a different style mounting flange 162 compared to flange 62 of motor housing 12. Also differently from the motor housing 12, the motor housing 112 does not include a hydraulic brake portion with brake members, but rather is used for mounting of the hydraulic motor 110 to a specified application. An example of the hydraulic motor 112 is a Typical LSHT hydraulic motor by Parker-Hannifin Corporation of Cleveland, Ohio having hydraulic motor part number TG0240MS050AAAA, with motor housing part number ME012001A3 and motor subassembly part number MSKTG0240S0AAAA.

Because the motor subassembly may be a discrete modular unit that is operably coupled to the hydraulic motor housing and output shaft, the motor subassembly and the motor housing are understood by those having ordinary skill in the art to be distinct elements that together form the hydraulic motor. As such, it is understood that the motor subassembly in these examples is considered that portion of the hydraulic motor that does not contain the motor fluid housing with external fluid ports that enable operation of the motor via fluid communication with the fluid source, but rather the motor subassembly is that portion of the motor that receives the hydraulic fluid and generates torque, such as with the torque generator. The motor subassembly also may be considered that portion of the motor that does not contain mounting locations for mounting the hydraulic motor to the end-use machine, and also is devoid of the main output shaft. In some cases the motor subassembly may have fluid communication ports on the rear cover, but is still considered the working element of the hydraulic motor that pairs with the motor housing and shaft to form a complete and functional motor.

Because the motor subassembly includes many of the moving components that generate and transfer the torque provided by the motor, these components of the motor subassembly can wear out and may need to be replaced over time. Traditionally, individual components of the motor subassembly are ordered from the manufacturer and shipped in individual packages to the assembler, where the motor subassembly components are then assembled to the motor housing to refurbish the hydraulic motor. This can include up to twelve or more such individual components of the motor subassembly being packaged, transported, tracked, and stored, which results in wasted time and expense for both the manufacturer and assembler.

According to an aspect of the present disclosure, a provisional carrier for the motor subassembly is provided that enables the one or more components of the motor subassembly to be temporarily bundled into a compact, easy-to-transport motor subassembly kit. As discussed in further detail below, the provisional carrier is a non-hydraulically-functioning member that may be configured to have one or more features that mimic a corresponding one or more features of the corresponding hydraulically-operable motor housing (e.g. 12, 112) to which the motor subassembly in the kit is intended to be coupled for forming the hydraulic motor.

Referring to FIGS. 4-7, an exemplary carrier 201 for an exemplary motor subassembly kit 200 is shown. In the illustrated embodiment, the carrier 201 includes a body 203 having a first end portion 205 also referred to as the nose portion, a second end portion 207 opposite from the first end portion and also referred to as the base portion, and an intermediate portion 209 extending between the nose portion 205 and the base portion 207. As shown, the base portion 207 has an opening 211 that is configured to receive one or more components of the motor subassembly 14, and the body 203 has a recessed portion 213 with internal surfaces 215 that extend inwardly into the body 203 from the opening 211 toward the nose portion 205 to form an enclosure for containing the one or more components of the motor subassembly 14. For example, the carrier 201 may be configured to receive and/or contain the fasteners 30, the torque transferor 22 (e.g., drive link), one or more seals 36, and/or other components of the motor subassembly 14.

In the illustrated embodiment, the carrier body 203 forms an enclosure with no other openings other than the opening 211 in the base portion 207, such that the body 203 may confine the motor components therein, and may prevent the spillage of oils or other fluids that could contaminate items such as the dunnage that is used during transportation, for example. In exemplary embodiments, the carrier 201 may have pockets or areas configured to contain desiccants, anti-rusting agents, absorbent bags, or the like, which may further enhance transportability. For example, as shown in the illustrated embodiment, a bottom portion 219 of the recess 213 proximal the nose portion 205 of the body, is configured to contain the torque transferor 22, and this bottom recessed portion 219 may be configured with a greater axial depth to provide a pocket (shown at 217) for containing such a desiccant bag or the like. Also as shown, the nose portion 205 of the body may be tapered radially inwardly, and the body 203 may include scallops 221 with supporting ribs 223 for minimizing the weight of the carrier 201.

As discussed above, because the carrier 201 is intended to temporarily bundle the motor subassembly components for facilitating transportation and handling, the carrier 201 is a non-hydraulically-operating member, and thus does not contain fluid ports suitable for transferring pressurized hydraulic fluid; nor does the carrier include a fluid housing suitable for containing or transferring pressurized hydraulic fluid; nor does the carrier include an egress point for the shaft or suitable construction for bearing supports. As discussed above, the output shaft 18, 118 also may be considered a part of the motor housing assembly 12, 112, and thus the carrier 201 also may be devoid of this component.

In exemplary embodiments, the carrier body 203 is made of plastic, such as polypropylene, or other similar suitable plastic. The body 203 may be a unitary thin shell of a rigid plastic made from an injection molding process. Generally, the portions of the body 203 should be configured with sufficient strength to cooperate with the motor subassembly components to secure the motor subassembly 14 and facilitate transportation thereof. In exemplary embodiments, the carrier 201 may be reusable to facilitate returning of parts from the field or from the assembler, for example. It is understood, however, that the carrier 201 also may be inexpensive enough to be disposable.

As discussed above, to further enhance the functionality of the carrier 201, and to further facilitate transportation and handling of the components of the motor subassembly 14, the carrier 201 may be configured to have one or more features that mimic a corresponding one or more features of the corresponding hydraulically-operable motor housing (e.g., 12 or 112, for example) to which the motor subassembly 14 is intended to be coupled for forming the hydraulic motor (e.g., 10 or 110, for example). Generally, such portions of the motor housing 12 that are to be mimicked by the carrier 201 have preexisting radial and/or axial locations on the housing 12 that are relative to a longitudinal axis (L) of the motor subassembly 14 when the motor subassembly is properly secured to the housing 12. As such, those mimicking portions of the carrier 201 may therefore have radial and/or axial locations on the carrier 201 relative to the longitudinal axis (L) of the same motor subassembly 14 when the subassembly is secured to the carrier 201, that are the same as or similar to the preexisting radial and/or axial locations on the motor housing 12 to facilitate such mimicry. Several non-limiting examples of these mimicking features are discussed in further detail below.

For example, as shown in FIGS. 1 and 2 in the assembly of the hydraulic motor 12, the fasteners 30 of the motor subassembly 14 are configured to be received within corresponding housing receivers 31 disposed at preexisting locations of the hydraulically-operable motor housing for securing the motor subassembly 14 to the hydraulically-operable motor housing 12. To mimic such features and to facilitate securing the plurality of motor components to the carrier for enhancing transportability, the carrier 201 includes carrier receivers 231 disposed at locations that correspond with the preexisting locations of the housing receivers 31. The carrier receivers 231 are configured to receive the same fasteners 30, thereby allowing the plurality of motor components to be secured to the carrier 201 as an easily transportable bundle. More particularly, as shown in the illustrated examples, the preexisting housing receivers 31 are disposed at certain radial and axial locations relative to the longitudinal axis (L) of the motor subassembly 14 to receive the fasteners 30, and the carrier receivers 231 are located at the same or similar radial and axial positions to receive the same fasteners 30.

In the illustrated embodiment, the carrier receivers 231 are disposed within the recess 213 of the body 203 at the intermediate portion 209. As discussed above, the carrier body 203 may be made of plastic, and the carrier receivers 231 may be metal inserts in the body 203. The metal inserts may be made of a suitable metal, such as aluminum or brass, and may have internal threads that are configured to mimic the threads of the housing receivers 31 to receive the fasteners 30. It is understood, however, that the carrier receivers 231 may be formed integrally within the carrier body 203, or may include other suitable receivers as understood by those having ordinary skill in the art.

In exemplary embodiments, the motor subassembly 14 includes the end cover 28 with end cover receivers **28*a*, such as through-holes, that receive the fasteners 30 along the longitudinal axis (L) of the motor subassembly 14 and cooperate with the carrier receivers 231 to sandwich and secure the components of the motor subassembly 14 between the carrier 201 and the end cover 28**. Sandwiching the motor components in this way provides a more compact motor subassembly bundle that can be easily secured to the carrier simply by receiving the fasteners, and thus further enhances the securement and transportability of the motor subassembly kit.

Another such portion of the carrier that mimics the hydraulically-operable motor housing 12 includes support region(s) 241, such as for example on a flange 243 of the carrier 201, that are at locations that correspond with locations of support region(s) 41 of the motor housing 12, such as on flange 43 of the motor housing 12, as shown in FIG. 2, for example. Typically, such hydraulic motors (as shown in FIG. 2, for example) are transported in specifically configured dunnage that support the motor 10 at the support regions 41 of the motor housing 12. Moreover, during assembly of the motor subassembly 14 to the motor housing 12, workstations may be provided with specifically designed platforms for supporting the motor housing 12 at the support regions 41. Thus, having the support regions 241 on the carrier 201 mimics the support regions 41 on the housing 12 and allows the motor subassembly kit 200 with carrier 201 to be transported in existing dunnage and/or utilize the preexisting workstation platforms to facilitate transportation and/or assembly of the motor subassembly.

In exemplary embodiments, the carrier flange 243 is located at the intermediate portion 209 or the base portion 207 of the body 203 and extends radially outwardly from the body 203 to form the support regions 241. In the illustrated embodiment, the base portion 207 of the body has a generally cylindrical shape, and the flange 243 has a generally square shape, such that the support regions 241 have a generally triangular shape. The flange 243 generally may have an axial thickness suitable for providing the strength required for supporting the motor subassembly 14. In some embodiments, the flange 243 may have other strengthening features, such as strengthening ribs or other reinforcement. In exemplary embodiments, the flange 243 may have detents (as shown), protrusions, recesses, webbing, and/or other surface texturing for facilitating transportation and/or handling of the motor subassembly kit 200.

It is understood that the mimicking portions of the carrier described above are non-limiting examples, and other portions of the carrier may mimic portions of the hydraulically-functioning motor housing. For example, as shown in FIG. 2 in the assembly of the hydraulic motor 12, the torque transfer member 22 is received within the output shaft 18, which is received through the rear housing segment 42. As such, in the illustrated embodiment, the carrier 201 is configured with the bottom portion 219 of the recess in the body to be at the same radial location, and with sufficient axial depth, to mimic the receipt of the torque transferor 22 into the actual motor housing 12. Alternatively or additionally, as shown in FIG. 2 in the assembly of the hydraulic motor 12, the O-ring seal **36*a* that is between the wear plate 34 and the rear housing segment 42 is received within a radial groove (hidden from view) at a preexisting location in the motor housing 12, and the carrier 201 may include a radial groove 251 formed in the recessed internal surfaces 215 of the carrier for receiving the O-ring seal 36*a* at a location that corresponds with the preexisting location of the radial groove in the motor housing 12**.

It is understood that although certain mimicking features of the carrier 201 have been described above, other mimicking features of the motor housing (e.g., 12 or 112, for example) by the carrier may be employed, as may be desirable for particular applications, and which would be understood by those having ordinary skill in the art. It is furthermore understood that while some of these mimicking feature(s) may be specific to a particular motor housing (e.g., 12 or 112, for example), the mimicking feature(s) on the carrier 201 may be configured to be generic enough to encompass such feature(s) across multiple housing designs while still achieving the functionality of the mimicking feature(s). By way of example and not limitation, the flange 243 of the carrier 201 could be configured with support regions that encompass the support regions of both motor housings 12, 122 shown in FIGS. 2 and 3, for example.

It is understood that the configuration of the carrier described above is exemplary and other configurations of the carrier are possible. For example, referring to FIGS. 8-12, another exemplary embodiment of a carrier 301 is shown, in which the same reference numerals, but in the 300-series, are used to denote structures corresponding to similar structures between the respective carriers 201 and 301. As shown, the carrier 301 is substantially similar to the above-referenced carrier 201, except that a flange 343 of the carrier 301 extends radially outwardly more than the flange 243 of the carrier 201. In addition, the flange 343 includes surface texturing at its support regions 341, rather than detents at the support regions 241 of carrier 201. In addition, the carrier 301 has webbing 345 on an opposite side of the flange 343 to further enhance handleability. The carrier 301 also includes a label 347, such as with a QR code, which may be utilized to indicate the part number for the motor subassembly 14, the specific components contained in the kit, and/or the specific arrangement of those components in the kit. It is understood that the foregoing description of the carrier 201 is equally applicable to the carrier 301, except as noted above, and therefore aspects of the carriers 201, 301 may be substituted for one another or used in conjunction with one another where applicable.

Referring to FIGS. 13-18, another exemplary embodiment of a carrier 401 is shown, in which the same reference numerals, but in the 400-series, are used to denote structures corresponding to similar structures between the respective carriers 201, 301 and 401. It is understood that the foregoing description of the carrier(s) 201, 301 are equally applicable to the carrier 401, except as noted below, and therefore aspects of the carriers 201, 301, 401 may be substituted for one another or used in conjunction with one another where applicable.

As shown, the carrier 401 is substantially similar to the above-referenced carrier 201, except that a flange 443 of the carrier 401 includes apertures 465 at support regions 441. Similarly to the carrier 201, the carrier 401 having the support regions 441 mimics the support regions 41 on the housing 12 and allows the motor subassembly kit with carrier 401 to be transported in existing dunnage and/or utilize the preexisting workstation platforms to facilitate transportation and/or assembly of the motor subassembly. In addition, the apertures 465 serve as locators and/or fixturing regions that enhance the useability of the carrier 401 for preexisting workstations during assembly of the motor subassembly.

In addition, the carrier 401 has two large slots 467 in base portion 407 of the body 403. As shown, the slots 467 extend circumferentially and axially on opposite sides of the base portion 407 to form a generally trapezoidal shape. The slots 467 are configured to further enhance handleability of the motor subassembly kit with carrier 401, and better allow the motor subassembly to be grasped and removed from the carrier 401 during assembly of the motor subassembly.

Figure 18:
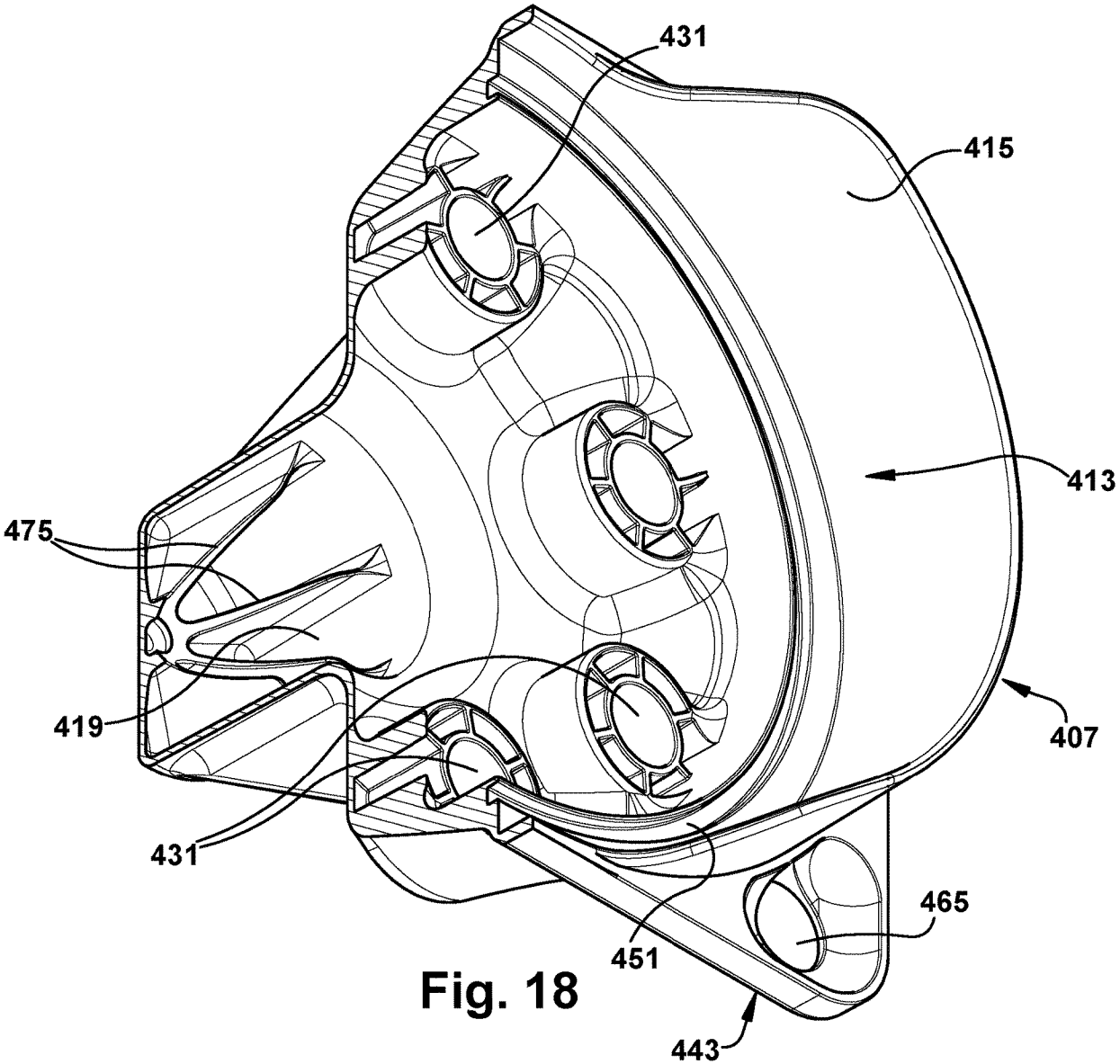
FIG. 18 is a cross-sectional perspective view of the carrier in FIG. 13.

As shown, the carrier 401 also includes one or more axially protruding portions 475 in a bottom portion 419 of recess 413 proximal nose portion 405 of the body 403. In the illustrated embodiment, the protruding portions 475 are configured as a plurality of circumferentially spaced apart ridges 475 which generally form a star-shaped pattern. As best shown in FIG. 18, each of the protruding portions or ridges 475 has a generally parabolic shape such that this region is configured to enhance containment of the torque transferor 22. For example, each of the axially protruding and circumferentially spaced apart ridges 475 may be configured to be received in the spaces between the teeth or splines 22*b* of the torque transferor 22 so as to restrict movement of the torque transferor 22 when being transported in the carrier 401.

As discussed above, the exemplary embodiment(s) of the carrier enables the components of the motor subassembly to be temporarily bundled into a single compact, easy-to-order, easy-to-assemble, easy-to-transport, and/or easy-to-store kit. Thus, according to an aspect of the present disclosure, a method of preparing the kit may include: (i) providing a non-hydraulically-operable carrier as described above; and (ii) arranging the motor components in a predefined order, such as shown and described above. According to another aspect of the present disclosure, a method of transporting a motor subassembly for a hydrostatic transmission may include the steps of: (i) providing a non-hydraulically-operable carrier as described above; (ii) providing a motor subassembly having one or more of the motor components described above; (iii) securing the carrier to the motor subassembly to form a motor subassembly kit as a transportable bundle; and (iv) transporting the motor subassembly kit bundle.

It is understood that the exemplary kit described above may be utilized as a replacement kit for refurbishing the motor subassembly of an existing hydraulic motor, or may be utilized for transporting the components to an assembler for a new motor build. It is furthermore understood that although the carrier may be considered "temporary" or "provisional" for temporarily bundling the motor components into a compact kit during transportation, storage, and other handling, the temporary carrier also may be reusable, such that the exemplary kit with carrier may be utilized for returning shipment of the motor components to the supplier, for example. The carrier also may be inexpensive enough to be disposable, as may be desired for particular applications.

While a preferred form or forms of an exemplary carrier and/or motor subassembly kit have been described above, it should be apparent to those having ordinary skill in the art that other carriers and/or motor subassemblies could also be used in accordance with the present disclosure. As such, the principles and aspects of the present disclosure are not limited to any particular carrier, but rather are appropriate for a wide variety of carriers that can mimic a wide variety existing hydraulic motor housings. The principles and aspects of the present disclosure also are not limited to any particular motor subassembly, but rather are appropriate for a wide variety of motor subassemblies, or one or more components thereof.

For example, in some embodiments, the motor subassembly may include a gear motor, in which the torque generator includes a gear set which is generally a combination of drive/idler gears, and the torque transferor includes an output shaft which is an extension of the drive gear.

In some embodiments, the motor subassembly may include a hydraulic brake motor, in which the torque generator includes the rotor set (commonly referred to as a gerotor set) including rotor, vanes, and a stator (and in some variants the rotor set includes only the rotor and stator), and the torque transferor includes a drive link or splined coupling member that transfers the generated torque from the torque generator to the output shaft. In the hydraulic brake motor, the fluid timer may include components described or referred to as a manifold and a commutator assembly for a given design and may also refer to a spool type valve or disc type valve for other design variants, and the thrust loader may include a hardened disc or plate commonly referred to as a wear plate.

In some embodiments, the motor subassembly may include a hydraulic radial piston motor, in which the torque generator includes a rotating group including pistons/cylinder block assembly, and the torque transferor includes a splined coupling member that transfers the generated torque from the torque generator to the output shaft or may be an extension of the coupling shaft. In the hydraulic radial piston motor, the fluid timer may include various versions of valve or timing plates.

In some embodiments, the motor subassembly may include a hydrostatic transmission motor, in which the torque generator includes the rotor set (commonly referred to as a gerotor set) including rotor, vanes, and a stator (and in some variants the rotor set includes only the rotor and stator), and the torque transferor includes a drive link or splined coupling member that transfers the generated torque from the torque generator to the output shaft. In the hydrostatic transmission motor, the fluid timer may include components described or referred to as a manifold and a commutator assembly for a given design and may also refer to a spool type valve or disc type valve for other design variants, and the thrust loader may include a hardened disc or plate commonly referred to as a wear plate In some embodiments, the motor subassembly may include a hydraulic vane motor, in which the torque generator may include items such as the rotor, vanes, and shroud or stator; and the torque transferor includes a splined coupling member that transfers the generated torque from the torque generator to the output shaft or may be an extension of the coupling shaft. In the hydraulic vane motor, the fluid timer may include various manifold or valve plates, and the thrust loader may include a hardened disc or plate operating in proximity to the vane rotor set.

In some embodiments, the motor subassembly may include a bent axis motor, in which the torque generator includes a rotating group including pistons/cylinder block assembly, and the torque transferor includes a splined coupling member that transfers the generated torque from the torque generator to the output shaft or may be an extension of the coupling shaft. In the bent axis motor, the fluid timer may include a valve plate or other similar means to direct fluid into and out of the rotating group, and the thrust loader may include bearings or hardened components or a combination thereof.

A carrier for a motor subassembly, and kit thereof, has been described herein. The motor subassembly kit may provide all the components for a hydraulic motor except for the hydraulic motor housing and main output shaft, all in one compact, easy-to-order, easy-to-assemble, easy-to-handle, easy-to-ship, easy-to-store motor cartridge style assembly. The carrier may be designed to mimic portions of a standard motor housing for ease of assembly, handling, packaging and transportation. For example, the carrier may mimic portions of the standard motor housing for use in existing assembly processes and workstations, and to be easily packaged into existing dunnage for simplicity. The carrier may enable the following of standard processes for motor assembly and utilize standard fixtures to assemble the motor service kit. The carrier also may be reusable for returning parts from the field or from an original equipment manufacturer. The motor subassembly kit may allow for a single part number to be ordered, instead of ordering up to twelve or more individual components, saving time, money and effort for both the customer/assembler and the supplier/manufacturer. The benefit to the supplier is multi-fold, with a large benefit being the potential to eliminate, or at least minimize, the bulk packaging of individual components for distributors, build centers, and inter-company transfer locations. Space may be allotted in a pocket of the carrier for a desiccant bag or other anti-rust module. The carrier may have built-in receivers to receive standard displacement-specific fasteners, or bolts, that are subsequently used in the installation process of the motor subassembly to the motor housing. The carrier also may have preformed touch points for enhancing handling and/or packaging.

According to an aspect of the invention, a motor subassembly kit for a hydraulic motor includes: a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly; wherein the carrier cooperates with the motor subassembly to temporarily secure the plurality of motor components of the motor subassembly as a transportable bundle, and wherein the carrier has one or more portions that mimic a corresponding one or more portions of the hydraulically-operable motor housing, thereby facilitating transportation of the plurality of motor components in the transportable bundle.

Embodiments of the invention may include one or more of the following additional features, separately or in any combination.

In some embodiments, the carrier includes a body having a nose portion, a base portion, and an intermediate portion extending between the nose portion and the base portion.

In some embodiments, the carrier has an opening in the base portion for receiving one or more of the plurality of motor components.

In some embodiments, the carrier has a recessed portion that extends inwardly into the body from the opening in the base portion toward the nose portion to form an enclosure for at least partially containing the one or more motor components.

In some embodiments, the carrier is devoid of fluid ports for transferring pressurized hydraulic fluid.

In some embodiments, the plurality of motor components includes fasteners configured to be received within corresponding housing receivers disposed at preexisting locations of the hydraulically-operable motor housing for securing the motor subassembly to the hydraulically-operable motor housing.

In some embodiments, the one or more portions of the non-hydraulically-operable carrier that mimic the hydraulically-operable motor housing include carrier receivers disposed at locations that correspond with the preexisting locations of the housing receivers, and that receive the fasteners to secure the plurality of motor components as the transportable bundle.

In some embodiments, the carrier includes a nose portion, a base portion, and an intermediate portion extending between the nose portion and the base portion.

In some embodiments, the carrier has an opening in the base portion for receiving the fasteners, and the carrier has a recessed portion that extends inwardly into the body from the opening in the base portion toward the nose portion to form an enclosure for at least partially containing the fasteners.

In some embodiments, the carrier receivers are disposed within the recess in the intermediate portion of the body, the carrier receivers having threaded portions for threadably receiving the fasteners.

In some embodiments, a body of the carrier is made of plastic, and the carrier receivers are metal inserts in the body, the metal inserts having internal threads for threadably receiving the fasteners.

In some embodiments, the plurality of motor components includes an end cover with end cover receivers, the end cover receivers receiving the fasteners along a longitudinal axis of the motor subassembly to sandwich the other plurality of motor components between the carrier and the end cover.

In some embodiments, the carrier includes a flange.

In some embodiments, the one or more portions of the non-hydraulically-operable carrier that mimic the hydraulically-operable motor housing include support regions at locations on the flange that correspond with locations of support regions of the hydraulically-operable motor housing, such that the support regions of the carrier can facilitate transportation of the bundle in existing dunnage.

In some embodiments, the flange has one or more locator structures, such as detents, through-holes, and/or surface texturing for facilitating assembly of the motor subassembly in a manufacturing environment and/or to facilitate transportation of the motor subassembly bundle.

In some embodiments, the carrier includes a nose portion, a base portion, and an intermediate portion between the nose portion and the base portion, wherein the base portion has an opening for receiving one or more of the plurality of motor components, and wherein the flange is located at the intermediate portion.

In some embodiments, the base portion includes one or more circumferentially extending slots that extend axially from the opening toward the nose portion for facilitating removal of the motor subassembly from the carrier.

In some embodiments, the one or more of the plurality of motor components includes an O-ring seal configured to be received within a radial groove at a preexisting location in the hydraulically-operable motor housing.

In some embodiments, a body of the carrier has recessed internal surfaces that form an enclosure for containing at least the O-ring seal.

In some embodiments, the one or more portions of the non-hydraulically-operable carrier that mimic the hydraulically-operable motor housing include a radial groove formed in the recessed internal surfaces of the carrier for receiving the O-ring seal at a location that corresponds with the preexisting location of the radial groove in the hydraulically-operable motor housing.

In some embodiments, the plurality of motor components includes a torque transferor.

In some embodiments, a body of the carrier includes a nose portion, a base portion, an intermediate portion between the nose portion and the base portion, and a recess that extends inwardly into the body from the base portion toward the nose portion to form an enclosure for containing one or more of the plurality of motor components.

In some embodiments, a bottom portion of the recess proximal the nose portion of the body is configured to contain the torque transferor.

In some embodiments, the bottom portion of the recess proximal the nose portion of the body includes one or more axially extending ridges that are configured to be received by corresponding portions of the torque transferor to restrict rotation of the torque transferor when contained by the carrier.

In some embodiments, the nose portion of the body is tapered and includes scallops for minimizing weight of the carrier.

In some embodiments, the plurality of motor components of the motor subassembly includes: a torque transferor, a torque generator, and a fluid manifold. In some embodiments, the plurality of components of the motor subassembly further includes: a fluid timer, an end cover, and fasteners.

In some embodiments, the plurality of components of the motor subassembly further includes: a wear member, a thrust loader, and seals.

In some embodiments, the motor subassembly is a gerotor configuration; wherein the torque transferor is a longitudinally extending drive link having a plurality of teeth; wherein the torque generator is a rotor assembly; wherein the fluid timer is a commutator; and wherein the thrust loader is a thrust bearing.

In some embodiments, the motor subassembly is devoid of external fluid ports.

According to another aspect of the invention, a non-hydraulically-operable carrier for temporarily carrying a motor subassembly configured to be coupled to a hydraulically-operable motor housing for forming a hydraulic motor, the carrier including: a body having a first end portion, a second end portion, and an intermediate portion between the first end portion and the second end portion; and a recessed portion within the body, the recessed portion having an opening for receiving a portion of the motor subassembly, the recessed portion forming an enclosure that is configured to contain the portion of the motor subassembly; wherein the carrier is configured to cooperate with the motor subassembly to temporarily secure the motor subassembly as a transportable bundle, and wherein the carrier has one or more portions that mimic a corresponding one or more portions of the hydraulically-operable motor housing, thereby facilitating transportation of the motor subassembly.

Embodiments of the invention may include one or more of the following additional features, separately or in any combination.

In some embodiments, the carrier is devoid of hydraulic fluid ports.

In some embodiments, one of the one or more portions of the non-hydraulically-operable carrier that mimic the hydraulically-operable motor housing includes carrier receivers disposed in the body of the carrier at locations that are configured to correspond with preexisting locations of corresponding receivers in the hydraulically-operable motor housing, the carrier receivers being configured to receive fasteners of the motor subassembly to secure the motor subassembly to the carrier as the transportable bundle.

In some embodiments, another one of the one or more portions of the carrier that mimic the hydraulically-operable motor housing includes a flange with support regions at locations that correspond with preexisting support regions of a flange of the hydraulically-operable motor housing, such that the support regions of the carrier can facilitate transportation of the bundle in existing dunnage.

According to another aspect of the invention, a method of transporting a motor subassembly for a hydraulic motor includes: (i) providing the non-hydraulically-operable carrier according to one or more of the foregoing aspects and/or features; (ii) providing a motor subassembly having one or more of the following motor components: a torque transferor, a torque generator, a fluid manifold, a fluid timer, an end cover, and fasteners; (iii) securing the carrier to the motor subassembly to form motor subassembly kit as a transportable bundle; and (iv) transporting the motor subassembly kit.

In the description above, it is understood that positional terms such as "top," "bottom," "upper," "lower," "left," "right," "front," "rear," "horizontal," "vertical," and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference depending on the transmission configuration, as understood by those having ordinary skill in the art.

Also in the description above and to follow, the term "transport" or variants thereof should be understood to mean any movement from one place to another, and not just shipping or transporting in the sense of some type of vehicle movement, it furthermore being understood that such transportation may include such movement by man, machine or otherwise, which may occur within a facility, between facilities, and the like.

As used herein, an "operable connection," or a connection by which entities are "operably connected," is one in which the entities are connected in such a way that the entities may perform as intended. An operable connection may be a direct connection or an indirect connection in which an intermediate entity or entities cooperate or otherwise are part of the connection or are in between the operably connected entities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A motor subassembly kit for a hydraulic motor, the kit comprising:

a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly;

wherein the carrier cooperates with the motor subassembly to temporarily secure the plurality of motor components of the motor subassembly as a transportable bundle, wherein the carrier has one or more portions that mimic a corresponding one or more portions of the hydraulically-operable motor housing, thereby facilitating transportation of the plurality of motor components in the transportable bundle, wherein the plurality of motor components includes fasteners configured to be received within corresponding housing receivers disposed at preexisting locations of the hydraulically-operable motor housing for securing the motor subassembly to the hydraulically-operable motor housing, and wherein the one or more portions of the non-hydraulically-operable carrier that mimic the hydraulically-operable motor housing include carrier receivers disposed at locations that correspond with the preexisting locations of the housing receivers, and that receive the fasteners to secure the plurality of motor components as the transportable bundle.

2. The motor subassembly kit according to claim 1, wherein the carrier includes a body having a nose portion, a base portion, and an intermediate portion extending between the nose portion and the base portion;

wherein the carrier has an opening in the base portion for receiving one or more of the plurality of motor components, and wherein the carrier has a recessed portion that extends inwardly into the body from the opening in the base portion toward the nose portion to form an enclosure for at least partially containing the one or more motor components.

3. The motor subassembly kit according to claim 2, wherein the carrier is devoid of fluid ports for transferring pressurized hydraulic fluid.

4. The motor subassembly kit according to claim 1, wherein the carrier includes a nose portion, a base portion, and an intermediate portion extending between the nose portion and the base portion, wherein the carrier has an opening in the base portion for receiving the fasteners, and the carrier has a recessed portion that extends inwardly into the body from the opening in the base portion toward the nose portion to form an enclosure for at least partially containing the fasteners; and wherein the carrier receivers are disposed within the recessed portion in the intermediate portion of the body, the carrier receivers having threaded portions for threadably receiving the fasteners.

5. The motor subassembly kit according to claim 1, wherein a body of the carrier is made of plastic, and the carrier receivers are metal inserts in the body, the metal inserts having internal threads for threadably receiving the fasteners.

6. The motor subassembly kit according to claim 1, wherein the plurality of motor components includes an end cover with end cover receivers, the end cover receivers receiving the fasteners along a longitudinal axis of the motor subassembly to sandwich the other plurality of motor components between the carrier and the end cover.

7. The motor subassembly kit according to claim 1, wherein the carrier includes a flange, and wherein the one or more portions of the non-hydraulically-operable carrier that mimic the hydraulically-operable motor housing include support regions at locations on the flange that correspond with locations of support regions of the hydraulically-operable motor housing, such that the support regions of the carrier can facilitate transportation of the bundle in existing dunnage.

8. The motor subassembly kit according to claim 7, wherein the flange has detents, through-holes, and/or surface texturing for providing locator structures that facilitate assembly of the motor subassembly in a manufacturing environment and/or facilitate transportation of the motor subassembly bundle.

9. The motor subassembly kit according to claim 1, wherein the plurality of motor components includes a torque transferor, wherein a body of the carrier includes a nose portion, a base portion, an intermediate portion between the nose portion and the base portion, and a recess that extends inwardly into the body from the base portion toward the nose portion to form an enclosure for containing one or more of the plurality of motor components; and wherein a bottom portion of the recess proximal the nose portion of the body is configured to contain the torque transferor.

10. The motor subassembly kit according to claim 9, wherein the nose portion of the body is tapered and includes scallops for minimizing weight of the carrier.

11. The motor subassembly kit according to claim 1, wherein the plurality of motor components of the motor subassembly includes: a torque transferor, a torque generator, and a fluid manifold.

12. The motor subassembly kit according to claim 11, wherein the motor subassembly is a gerotor configuration;

wherein the torque transferor is a longitudinally extending drive link having a plurality of teeth;

wherein the torque generator is a rotor assembly;

wherein the motor subassembly further includes a commutator and a thrust bearing.

13. A motor subassembly kit for a hydraulic motor, the kit comprising:

a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly;

wherein the carrier cooperates with the motor subassembly to temporarily secure the plurality of motor components of the motor subassembly as a transportable bundle, wherein the carrier has one or more portions that mimic a corresponding one or more portions of the hydraulically-operable motor housing, thereby facilitating transportation of the plurality of motor components in the transportable bundle, wherein the carrier includes a flange, wherein the one or more portions of the non-hydraulically-operable carrier that mimic the hydraulically-operable motor housing include support regions at locations on the flange that correspond with locations of support regions of the hydraulically-operable motor housing, such that the support regions of the carrier can facilitate transportation of the bundle in existing dunnage, and wherein the carrier includes a nose portion, a base portion, and an intermediate portion between the nose portion and the base portion, wherein the base portion has an opening for receiving one or more of the plurality of motor components, and wherein the flange is located at the intermediate portion.

14. The motor subassembly kit according to claim 13, wherein the base portion includes one or more circumferentially extending slots that extend axially from the opening toward the nose portion for facilitating removal of the motor subassembly from the carrier.

15. A motor subassembly kit for a hydraulic motor, the kit comprising:

a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly;

wherein the carrier cooperates with the motor subassembly to temporarily secure the plurality of motor components of the motor subassembly as a transportable bundle, wherein the carrier has one or more portions that mimic a corresponding one or more portions of the hydraulically-operable motor housing, thereby facilitating transportation of the plurality of motor components in the transportable bundle, wherein the one or more of the plurality of motor components includes an O-ring seal configured to be received within a radial groove at a preexisting location in the hydraulically-operable motor housing;

wherein a body of the carrier has recessed internal surfaces that form an enclosure for containing at least the O-ring seal; and wherein the one or more portions of the non-hydraulically-operable carrier that mimic the hydraulically-operable motor housing include a radial groove formed in the recessed internal surfaces of the carrier for receiving the O-ring seal at a location that corresponds with the preexisting location of the radial groove in the hydraulically-operable motor housing.

16. The motor subassembly kit according to claim 12, wherein the plurality of motor components includes a torque transferor, wherein a body of the carrier includes a nose portion, a base portion, an intermediate portion between the nose portion and the base portion, and a recess that extends inwardly into the body from the base portion toward the nose portion to form an enclosure for containing one or more of the plurality of motor components, wherein a bottom portion of the recess proximal the nose portion of the body is configured to contain the torque transferor, and wherein the bottom portion of the recess proximal the nose portion of the body includes one or more axially extending ridges that are configured to be received by corresponding portions of the torque transferor to restrict rotation of the torque transferor when contained by the carrier.

17. A motor subassembly kit for a hydraulic motor, the kit comprising:

a hydraulically-operable motor subassembly having a plurality of motor components that are configured to be operably coupled to a hydraulically-operable motor housing for at least partially forming the hydraulic motor; and a non-hydraulically-operable carrier for carrying the motor subassembly;

wherein the carrier cooperates with the motor subassembly to temporarily secure the plurality of motor components of the motor subassembly as a transportable bundle, wherein the carrier has one or more portions that mimic a corresponding one or more portions of the hydraulically-operable motor housing, thereby facilitating transportation of the plurality of motor components in the transportable bundle, wherein the plurality of motor components includes a torque transferor, wherein a body of the carrier includes a nose portion, a base portion, an intermediate portion between the nose portion and the base portion, and a recess that extends inwardly into the body from the base portion toward the nose portion to form an enclosure for containing one or more of the plurality of motor components, wherein a bottom portion of the recess proximal the nose portion of the body is configured to contain the torque transferor, and wherein the bottom portion of the recess proximal the nose portion of the body includes one or more axially extending ridges that are configured to be received by corresponding portions of the torque transferor to restrict rotation of the torque transferor when contained by the carrier.

18. The motor subassembly kit according to claim 17, wherein the one or more of the plurality of motor components includes an O-ring seal configured to be received within a radial groove at a preexisting location in the hydraulically-operable motor housing;

wherein a body of the carrier has recessed internal surfaces that form an enclosure for containing at least the O-ring seal; and wherein the one or more portions of the non-hydraulically-operable carrier that mimic the hydraulically-operable motor housing include a radial groove formed in the recessed internal surfaces of the carrier for receiving the O-ring seal at a location that corresponds with the preexisting location of the radial groove in the hydraulically-operable motor housing.

19. A non-hydraulically-operable carrier for temporarily carrying a motor subassembly configured to be coupled to a hydraulically-operable motor housing for forming a hydraulic motor, the carrier comprising:

a body having a first end portion, a second end portion, and an intermediate portion between the first end portion and the second end portion; and a recessed portion within the body, the recessed portion having an opening for receiving a portion of the motor subassembly, the recessed portion forming an enclosure that is configured to contain the portion of the motor subassembly;

wherein the carrier is configured to cooperate with the motor subassembly to temporarily secure the motor subassembly as a transportable bundle, and wherein the carrier has one or more portions that mimic a corresponding one or more portions of the hydraulically-operable motor housing, thereby facilitating transportation of the motor subassembly;

wherein the carrier is devoid of hydraulic fluid ports;

wherein one of the one or more portions of the non-hydraulically-operable carrier that mimic the hydraulically-operable motor housing includes carrier receivers disposed in the body of the carrier at locations that are configured to correspond with preexisting locations of corresponding receivers in the hydraulically-operable motor housing, the carrier receivers being configured to receive fasteners of the motor subassembly to secure the motor subassembly to the carrier as the transportable bundle; and wherein another one of the one or more portions of the carrier that mimic the hydraulically-operable motor housing includes a flange with support regions at locations that correspond with preexisting support regions of a flange of the hydraulically-operable motor housing, such that the support regions of the carrier can facilitate transportation of the bundle in existing dunnage.

20. A method of transporting a motor subassembly for a hydraulic motor, comprising:

(i) providing the non-hydraulically-operable carrier according to claim 19;

(ii) providing a motor subassembly having one or more of the following motor components: a torque transferor, a torque generator, a fluid manifold, a fluid timer, an end cover, and fasteners;

(iii) securing the carrier to the motor subassembly to form motor subassembly kit as a transportable bundle; and (iv) transporting the motor subassembly kit.

* * * * *